US007606519B2

(12) United States Patent
Mihara

(10) Patent No.: US 7,606,519 B2
(45) Date of Patent: Oct. 20, 2009

(54) TONER CONTAINER, TONER SUPPLY DEVICE USING THE SAME AND IMAGE FORMING APPARATUS USING THE TONER CONTAINER AND TONER SUPPLY DEVICE

(75) Inventor: Koichi Mihara, Fujiidera (JP)

(73) Assignee: Sharp Kabushiki Kaisha, Osaka (JP)

( * ) Notice: Subject to any disclaimer, the term of this patent is extended or adjusted under 35 U.S.C. 154(b) by 181 days.

(21) Appl. No.: 11/826,503

(22) Filed: Jul. 16, 2007

(65) Prior Publication Data

US 2008/0038022 A1 Feb. 14, 2008

(30) Foreign Application Priority Data

Aug. 14, 2006 (JP) ..... 2006-220990

(51) Int. Cl.
*G03G 15/08* (2006.01)

(52) U.S. Cl. ..... 399/258; 399/262

(58) Field of Classification Search ..... 399/258, 399/262, 260, 119, 120; 222/DIG. 1
See application file for complete search history.

(56) References Cited

U.S. PATENT DOCUMENTS

2006/0008298 A1* 1/2006 Koyama ..... 399/258
2006/0147228 A1* 7/2006 Nagahama et al. ..... 399/262
2007/0081834 A1* 4/2007 Koyama et al. ..... 399/258
2008/0013983 A1* 1/2008 Mihara ..... 399/258
2008/0013984 A1* 1/2008 Mihara ..... 399/262

FOREIGN PATENT DOCUMENTS

| | | |
|---|---|---|
| JP | 6-102758 A | 4/1994 |
| JP | 06-222665 | 8/1994 |
| JP | 06-348127 | 12/1994 |
| JP | 07-020705 | 1/1995 |
| JP | 08-339115 | 12/1996 |
| JP | 10-142936 | 5/1998 |
| JP | 2003-162143 | 6/2003 |
| JP | 2004-333854 | 11/2004 |

* cited by examiner

*Primary Examiner*—Sophia S Chen
(74) *Attorney, Agent, or Firm*—Nixon & Vanderhye, PC

(57) ABSTRACT

A toner container includes: a container body with a toner discharge aperture; and a toner container supporting structure which has a toner feed aperture and supports the container body in a rotatable manner, and discharges toner while rotating the container body. A toner feed recess 303 that is intended into the interior of the toner container is formed on the outer periphery of the container body so as to temporarily reserve the discharged toner. The toner feed recess is formed on the upstream side of the toner discharge aperture. The toner feed recess is formed so that its sectional opening area perpendicular to the rotational direction of the container body decreases from the downstream side to the upstream side of the rotational direction.

19 Claims, 16 Drawing Sheets

TONER CONTAINER, TONER SUPPLY DEVICE USING THE SAME AND IMAGE FORMING APPARATUS USING THE TONER CONTAINER AND TONER SUPPLY DEVICE

This Nonprovisional application claims priority under 35 U.S.C. §119(a) on Patent Application No. 2006-220990 filed in Japan on 14 Aug. 2006, the entire contents of which are hereby incorporated by reference.

BACKGROUND OF THE TECHNOLOGY

1. Field of the Technology

The present technology relates to a toner container, a toner supply device using this and an image forming apparatus using these, and in particular relates to a toner supply device for supplying toner in accordance with the amount of the toner used in a developing unit for image forming with toner, a replaceable toner container attached to and used in a toner supply device, and an image forming apparatus having these toner container or toner supply device.

2. Description of the Prior Art

Conventionally, in image forming apparatuses using toner, such as copiers, facsimile machines, etc., a toner supply device using a toner cartridge etc., is used to supply toner to the developing unit to thereby achieve continuous operation of image output.

Examples of generally known methods for supplying toner to the developing unit include: a configuration in which toner stored in a toner cartridge is directly supplied to the developing unit (Patent document 1: see Japanese Patent Application Laid-open 2003-162143); and a configuration in which toner in a toner cartridge is supplied by a screw from a predetermined position to the developing unit (Patent document 2: see Japanese Patent Application Laid-open Hei 10-142936).

Further, there is a technology by which toner is conveyed to a predetermined position by rotating the toner cartridge itself instead of using a screw (see Patent document 3: Japanese Patent Application Laid-open Hei 7-20705, Patent document 4: Japanese Patent Application Laid-open Hei 8-339115, and Patent document 5: Japanese Patent Application Laid-open Hei 6-348127).

In accordance with this system, since toner is conveyed by rotating the toner cartridge itself, it is not necessary to provide a screw for toner conveyance inside the toner cartridge, hence it is no longer necessary to consider the load on the screw when toner is conveyed. Accordingly, there is the advantage that the proportion of toner stored in the toner cartridge can be increased.

However, in the above-mentioned prior art, there is a fear that toner stagnates around the toner discharge port formed in the toner cartridge and spills out from the port when toner is supplied from the toner cartridge to the toner supply device. That is, there is the risk that toner cannot be supplied stably and efficiently. Further, spilt toner may dirty the operator and the machine, hence causing the problem of exerting adverse influence on the workability and maintenance performance.

SUMMARY OF THE TECHNOLOGY

The present technology has been devised in view of the above conventional problems, it is therefore an object of the present technology to provide a toner container which can supply toner with a simple structure, be handled easily without causing any spill of toner inside toner container and is improved in workability and maintenance performance, as well as to provide a toner supply device using the above mentioned toner container and an image forming apparatus using the aforementioned container and toner supply device.

The toner container and toner supply device using the container to solve the above problem are configured as follows.

A toner container comprises: a container body including a cylindrical toner storing portion to be charged with toner and a toner discharge port for discharging toner from the toner storing portion; a toner container supporting structure, which supports the container body in a rotatable manner by enclosing the toner discharge port and has a toner feed port for feeding the toner discharged from the toner discharge port to the outside, the container body being rotated about the cylinder axis of the toner storing portion as a rotational axis so as to discharge the toner charged in the toner storing portion to the outside of the container, and is characterized in that a toner pool having a recess that is indented into the interior of the toner container for temporarily reserving the toner discharged from the toner discharge port is formed on the outer periphery of the container body along the rotational direction thereof; the toner pool is formed on the upstream side of the toner discharge port with respect to the rotational direction of the container body; and the toner pool has a portion of which the sectional opening area perpendicular to the rotational direction decreases from the downstream side to the upstream side of the rotational direction.

That is, it is preferred that the sectional opening shape of the hollow of the toner pool, perpendicular to the rotational direction becomes smaller as it goes toward the upstream side with respect to the rotational direction of the container body.

Examples of the aforementioned toner pool may include a configuration of which the sectional opening area perpendicular to the rotational direction temporarily becomes large after its becoming smaller toward the upstream side with respect to the rotational direction of the container body.

A toner container is characterized in that, in addition to the configuration described in the above first aspect, the toner pool includes a first hollow whose surface opening opposing the toner feed port of the toner container supporting structure has a width that is approximately equal to the opening width of the toner feed port.

A toner container is characterized in that, in addition to the configuration described in the above first or second aspect, the toner pool includes a second hollow with a small surface opening width, extended to the upstream side of the rotational direction.

That is, the toner pool may be formed with a second hollow with its surface opening width gradually decreased toward the upstream side of the rotational direction, so as to collect the discharged toner.

A toner container is characterized in that, in addition to the configuration described in any one of the above first to third aspects, the toner feed port is disposed at a position more upstream, with respect to the rotational direction, from the position which the toner discharge port opposes when the port is positioned at the bottom dead center of rotation.

A toner supply device includes: a toner container filled with toner; and a toner feed device having the toner container mounted thereto for feeding toner discharged from the toner container to a developing unit, and is characterized in that the toner container is a toner container described in any one of the first to fourth aspects.

An image forming apparatus, includes a toner supply device comprising: a toner container filled with toner; and a toner feed device having the toner container mounted thereto for feeding toner discharged from the toner container to a developing unit, has a function of supplying toner to the developing unit by the toner supply device in accordance with the usage condition of the toner to be consumed for image output, and is characterized in that the toner supply device is a toner supply device described in the above fifth aspect.

Since the toner that has been discharged to the toner pool can be gathered and discharged efficiently, it is possible to give a stable supply of toner. Further, since the toner can be discharged from the toner container without causing any spilling of toner, it is possible to prevent contamination with toner and improve workability and maintenance performance when the container body is handled.

In addition to the above-described effects, the following effects can also be obtained.

That is, it is possible to discharge the gathered toner from the toner feed port, without causing any spilling of toner.

Since the toner that has been discharged to the toner pool moves downwards as the toner container is being rotated, it is possible to efficiently collect the toner.

Since the toner that has been gathered by rotation of the toner container can be discharged at the slope-sided position, deviated from the bottom dead center where there is no slope, the toner can move and be discharged efficiently.

The toner that is discharged to the toner pool can be efficiently collected and supplied to the toner supply device. Accordingly, it is possible to improve workability and maintenance performance without toner being spilled out inside the toner container, and furthermore it becomes possible to supply toner to the developing unit stably without waste of toner.

The toner that is discharged from the toner container can be supplied to the developing unit stably without waste of toner since no toner will spill out inside the toner container. Accordingly, this configuration contributes to improvement in the workability and maintenance performance of the toner supply device when the toner container is handled as well as to stable creation of high quality images.

DESCRIPTION OF THE PREFERRED EMBODIMENTS

Figure 1:
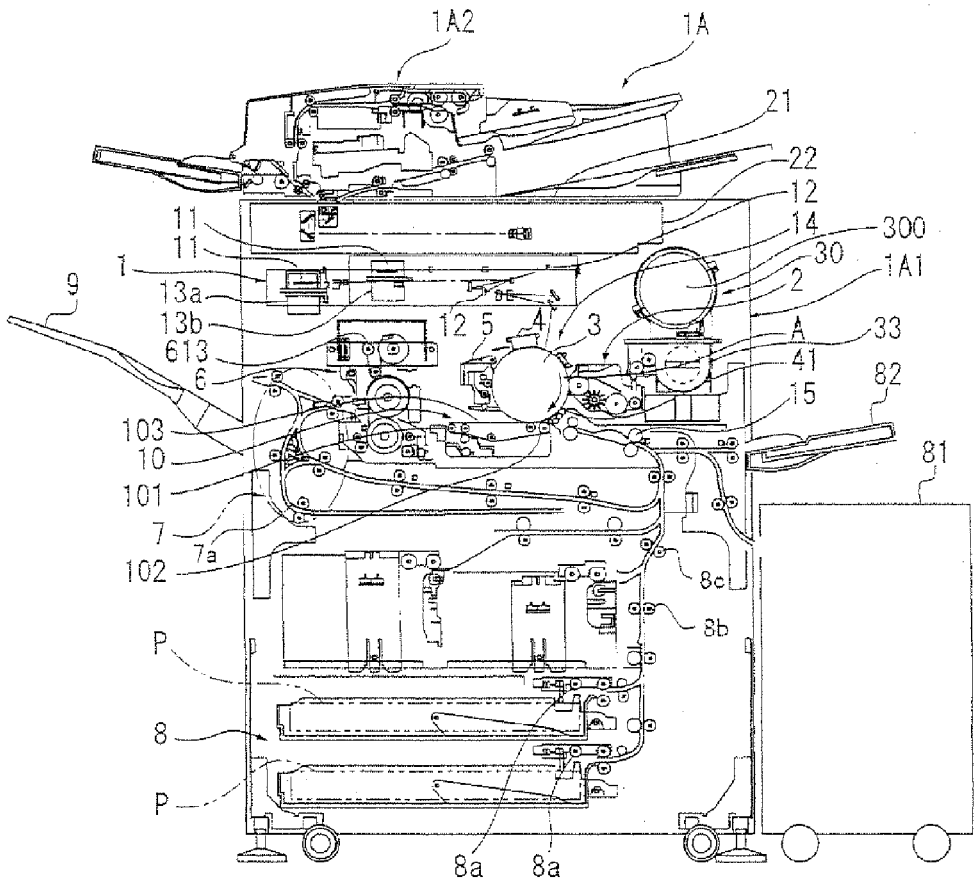
FIG. 1 is an illustrative view showing an overall configuration of an image forming apparatus in which a toner container and a toner supply device is used.
Figure 2:
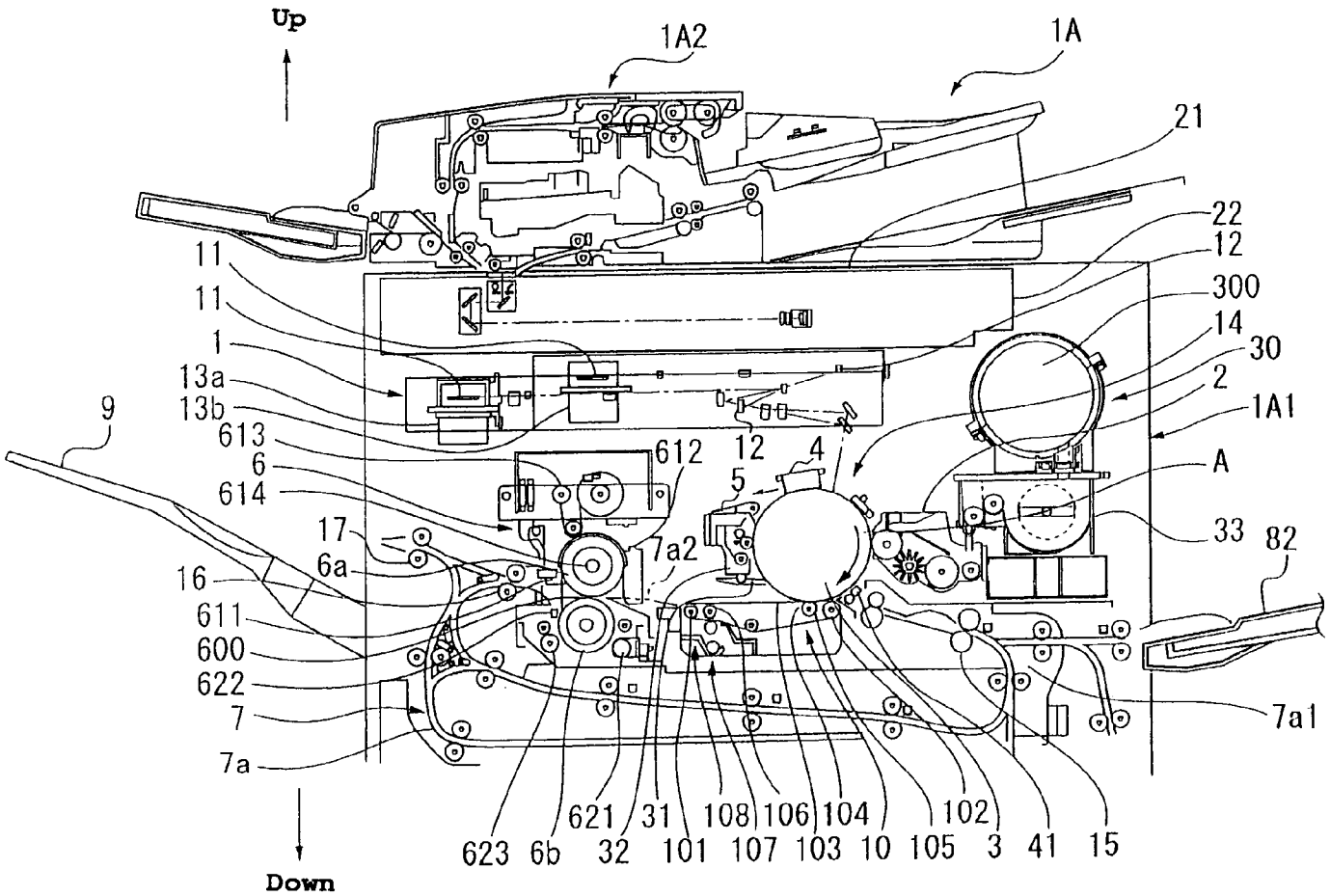
FIG. 2 is a partial detailed view showing the configuration of the apparatus body of the same image forming apparatus.

An embodiment of the present technology will hereinafter be described in detail with reference to the accompanying drawings. FIGS. 1 and 2 show one exemplary embodiment of the present technology. FIG. 1 is an illustrative view showing an overall configuration of an image forming apparatus in which a toner container and a toner supply device is used, and FIG. 2 is a partial detailed view showing the configuration of the apparatus body of the same image forming apparatus.

An image forming apparatus 1A according to the present embodiment is one that electrophotographically forms and outputs a monochrome image of the image data that was captured by a scanner or the like or the image data that was transferred from without, on a predetermined sheet of recording paper (to be referred to hereinbelow as paper) as a recording medium. Paper P in image forming apparatus 1A, as it is passing through paper feed paths (recording media feed paths) 7*a* that constitutes a paper conveyor system (recording media discharge means) 7 for conveying the paper, is conveyed whilst being controlled as to its speed of conveyance based on the speed of conveyance of paper P corresponding to the mode selected, in accordance with a print request, from a plurality of discharge processing modes that have been previously set, and discharged to a paper output tray 9. Image forming apparatus 1A includes a toner container 300 and a toner supply device 30 using toner container 300.

To begin with, the overall configuration of image forming apparatus 1A according to the present embodiment will be described with reference to the drawings.

Image forming apparatus 1A is essentially composed of, as shown in FIGS. 1 and 2, an apparatus body 1A1 including a light exposure unit 1, a developing unit 2, a photoreceptor drum 3, a charger 4, a charge erasing device 41, a cleaner unit 5, a fixing unit (fixing means) 6, paper conveyor system (recording media discharge means) 7, paper feed paths (recording media feed paths) 7*a*, paper feed tray 8, paper output tray 9, a transfer device 10 and the like, and an automatic document processor 1A2.

Formed on the top surface of apparatus body 1A1 is an original placement table 21 made of transparent glass on which a document is placed. Automatic document processor 1A2 is arranged on the top of this original placement table 21 so that it can pivotally open upwards while a scanner portion 22 as a document reader for reading image information of originals is laid out under this original placement table 21.

Arranged below scanner portion 22 are light exposure unit 1, developing unit 2, photoreceptor drum 3, charger 4, charge erasing device 41, cleaner unit 5, fixing unit 6, paper conveyor system 7, paper feed paths 7*a*, paper output tray 9 and transfer device 10. Further, paper feed tray 8 that accommodates paper P is arranged under these.

Light exposure unit 1 provides a function of emitting laser beam in accordance with the image data (printing image information) output from an unillustrated image processor to irradiate the photoreceptor drum 3 surface that has been uniformly charged by charger 4 so as to write and form an electrostatic latent image corresponding to the image data on the photoreceptor drum 3 surface.

This light exposure unit 1 is arranged directly under scanner portion 22 and above photoreceptor drum 3, and includes laser scanning units (LSUs) 13*a* and 13*b* each having a laser emitter 11 and a reflection mirror 12. In the present embodiment, in order to achieve high-speed printing operation, a method for alleviating a rush of irradiation timings by using a multiple number of laser beams, namely a two-beam method, is adopted.

Here, in the present embodiment laser scanning units (LSUs) 13*a* and 13*b* are used for light exposure unit 1, but an array of light emitting elements, e.g., an EL or LED writing head may also be used.

As shown in FIG. 2, photoreceptor drum 3 has an approximately cylindrical shape, is arranged under light exposure unit 1 and is controlled so as to rotate in a predetermined direction (in the direction of arrow A in the drawing) by an unillustrated drive means and control means. Arranged starting from the position at which image transfer ends downstream in the rotational direction of the photoreceptor drum along the peripheral surface of this photoreceptor drum 3 are a paper separation claw 31, cleaner unit 5, charger 4 as an electric field generator, developing unit 2 and charge erasing device 41 in the order mentioned.

Paper separation claw 31 is disposed so as to be moved into and out of contact with the outer peripheral surface of photoreceptor drum 3 by means of a solenoid 32. When this paper separation claw 31 is put in abutment with the outer peripheral surface of photoreceptor drum 3, it functions to peel off the paper P, which adhered to the photoreceptor drum 3 surface during the unfixed toner image on photoreceptor drum 3 being transferred to the paper.

Here, as a drive means for paper separation claw 31, a drive motor or the like may be used instead of solenoid 32, or any other drive means may be also selected.

Developing unit 2 visualizes the electrostatic latent image formed on photoreceptor drum 3 with black toner, and is arranged at approximately the same level at the side (on the right side in the drawing) of photoreceptor drum 3 downstream of charger 4 with respect to the rotational direction of the photoreceptor drum (in the direction of arrow A in the drawing). A registration roller 15 is disposed under this developing unit 2 on the upstream side with respect to the recording medium feed direction.

Registration roller 15 is operated and controlled by an unillustrated drive means and control means so as to convey the paper P delivered from paper feed tray 8 into and between photoreceptor drum 3 and a transfer belt 103 whilst making the leading end of the paper P register with the toner image on the photoreceptor drum 3.

Charger 4 is a charging means for uniformly charging the photoreceptor drum 3 surface at a predetermined potential, and is arranged over photoreceptor drum 3 and close to the outer peripheral surface thereof.

Here, a discharge type charger 4 is used in the present embodiment, but a contact roller type or a brush type may be used instead.

Charge erasing device 41 is a pre-transfer erasing means for lowering the surface potential of the photoreceptor drum 3 in order to facilitate the toner image formed on the photoreceptor drum 3 surface to transfer to paper P, and is laid out on the downstream side of developing unit 2 with respect to the photoreceptor drum's direction of rotation and under photoreceptor drum 3 and close to the outer peripheral surface of the same.

Though in the present embodiment, charge erasing device 41 is configured using a charge erasing electrode, a charge erasing lamp or any other method can be used to erase electricity instead of the charge erasing electrode.

Cleaner unit 5 removes and collects the toner left on the surface of photoreceptor drum 3 after development and image transfer, and is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper P whilst the paper is being conveyed and applied from transfer device 10 with an electric field having an opposite polarity to that of the electric charge of the electrostatic image.

For example, when the electrostatic image bears negative (−) charge, the applied polarity of transfer device 10 should be positive (+).

As shown in FIG. 2, transfer device 10 is provided as a transfer belt unit form in which a transfer belt 103 having a predetermined resistivity (ranging from $1\times10^{9}$ to $1\times10^{13}$ Ω·cm in the embodiment) is wound and tensioned on a drive roller 101, a driven roller 102 and other rollers, and is disposed under photoreceptor drum 3 with the transfer belt 103 surface put in contact with part of the outer peripheral surface of photoreceptor drum 3. This transfer belt 103 conveys paper P while pressing the paper against photoreceptor drum 3.

An elastic conductive roller 105 having a conductivity different from that of drive roller 101 and driven roller 102 and capable of applying a transfer electric field is laid out at a contact point 104 (FIG. 2) where transfer belt 103 comes into contact with photoreceptor drum 3.

Elastic conductive roller 105 is composed of a soft material such as elastic rubber, foamed resin etc. Since this elasticity of elastic conductive roller 105 permits photoreceptor drum 3 and transfer belt 103 to come into, not line contact, but area contact of a predetermined width (called a transfer nip) with each other, it is possible to improve the efficiency of transfer to the paper P being conveyed.

Further, a charge erasing roller 106 (FIG. 2) for erasing the electric field that has been applied to the paper P being conveyed through the transfer area so as to achieve smooth conveyance of the paper to the subsequent stage is disposed on the interior side of transfer belt 103, on the downstream side, with respect to the direction of paper conveyance, of the transfer area of transfer belt 103.

Transfer device 10 also includes a cleaning unit 107 for removing dirt due to leftover toner on transfer belt 103 and a plurality of charge erasing devices 108 for erasing electricity on transfer belt 103. Erasure of charge by erasing devices 108 may be performed by grounding via the apparatus or by positively applying charge of a polarity opposite to that of the transfer field.

The paper P with the static image (unfixed toner) transferred thereon by transfer device 10 is conveyed to fixing unit 6, where it is pressed and heated so as to fuse the unfixed toner and fix it to the paper P.

Fixing unit 6 includes a heat roller 6*a* and a pressing roller 6*b* as shown in FIG. 2 and fuses and fixes the toner image transferred on paper P by rotating heat roller 6*a* so as to convey the paper held between heat roller 6*a* and pressing 6*b* through the nip between heat roller 6*a* and pressing roller 6*b*.

Arranged on the downstream side of fixing unit 6 with respect to the direction of paper conveyance is a conveyance roller 16 for conveying paper P.

Heat roller 6*a* has a sheet separation claw 611, a roller surface temperature detector (thermistor) 612 and a roller surface cleaning member 613, all arranged on the outer periphery thereof and a heat source 614 for heating the heat roller surface at a predetermined temperature (set fixing temperature: approximately 160 to 200 deg. C.) provided in the interior part thereof.

Pressing roller 6*b* is provided at its each end with a pressing element 621 capable of abutting the pressing roller 6*b* with a predetermined pressure against heat roller 6*a*. In addition a sheet separation claw 622 and a roller surface cleaning element 623 are provided on the outer periphery of pressing roller 6*b*, similarly to the outer periphery of heat roller 6*a*.

In this fixing unit 6, as shown in FIG. 2 the unfixed toner on the paper P being conveyed is heated and fused by heat roller 6*a*, at the pressed contact (so-called fixing nip portion) 600 between heat roller 6*a* and pressing roller 6*b*, so that the unfixed toner is fixed to the paper P by its anchoring effect to the paper P by the pressing force from heat roller 6*a* and pressing roller 6*b*.

Paper feed tray 8 (FIG. 1) stacks a plurality of sheets (paper) to which image information will be output (printed), and is arranged under image forming portion 14 made up of light exposure unit 1, developing unit 2, photoreceptor drum 3, charger 4, charge erasing device 41, cleaner unit 5, fixing unit 6 etc. A paper pickup roller 8*a* and conveyor rollers 8*b* and 8*c* are disposed over the paper delivery side of this paper feed tray 8 (see FIG. 3).

This paper pickup roller 8*a* picks up paper P, sheet by sheet, from the topmost of a stack of paper stored in paper feed tray 8, and conveys the paper P downstream (for convenience' sake, the delivery side of paper P (the cassette side) is referred to as upstream and the paper output side is referred to as downstream) by conveyor rollers 8*b* and 8*c* to the registration roller (also called "idle roller") 15 side in paper feed paths 7*a*.

Since the image forming apparatus 1A according to the present embodiment is aimed at performing high-speed printing operations, a multiple number of paper feed trays 8 each capable of stacking 500 to 1500 sheets of standard-sized paper P are arranged under image forming portion 14. Further, a large-capacity paper feed cassette 81 capable of storing multiple kinds of paper in large volumes is arranged at the side of the apparatus while a manual feed tray 82 for essentially supporting printing etc. for irregular sized paper is arranged on the top of the large-capacity paper feed cassette 81.

Paper output tray 9 is arranged on the opposite side across the apparatus from that of manual feed tray 82. It is also possible to configure such a system that instead of paper output tray 9, a post-processing machine for output paper (device for stapling, punching and the like) and/or a multi-bin paper output tray etc., can be arranged as an option.

Paper feed paths 7*a* are laid out between the aforementioned photoreceptor drum 3 and paper feed tray 8, and convey paper P supplied from paper feed tray 8, sheet by sheet, to transfer device 10, where a toner image is transferred from photoreceptor drum 3 to the paper, further conveying the paper to fixing unit 6 where the unfixed toner image is fixed to the paper, then convey the paper as it is being guided by paper feed paths and branch guides, in accordance with the designated paper output processing mode.

In the image forming apparatus 1A according to the present embodiment, two predetermined paper output processing modes, namely, one-sided printing mode and two-sided printing mode are prepared. The one-sided printing mode includes two paper output modes, i.e., the faceup output by which the paper is discharged with its printed surface faceup and the facedown output by which the paper is discharged with its printed surface facedown.

Now, paper feed paths 7*a* will be described in detail with reference to the drawings.

Figure 3:
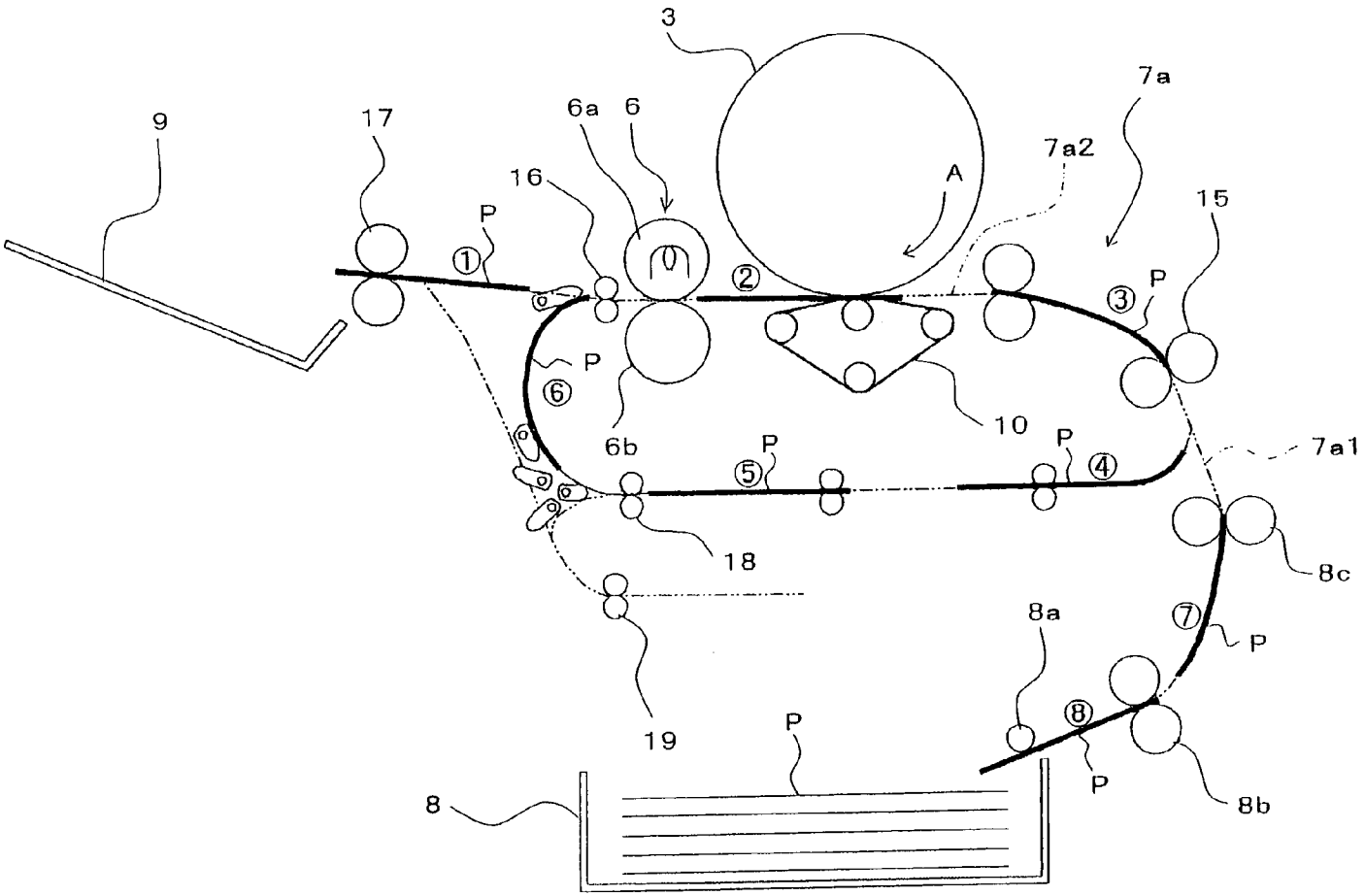
FIG. 3 is an illustrative view showing the configuration of a paper feed path system in the same image forming apparatus.
Figure 4:
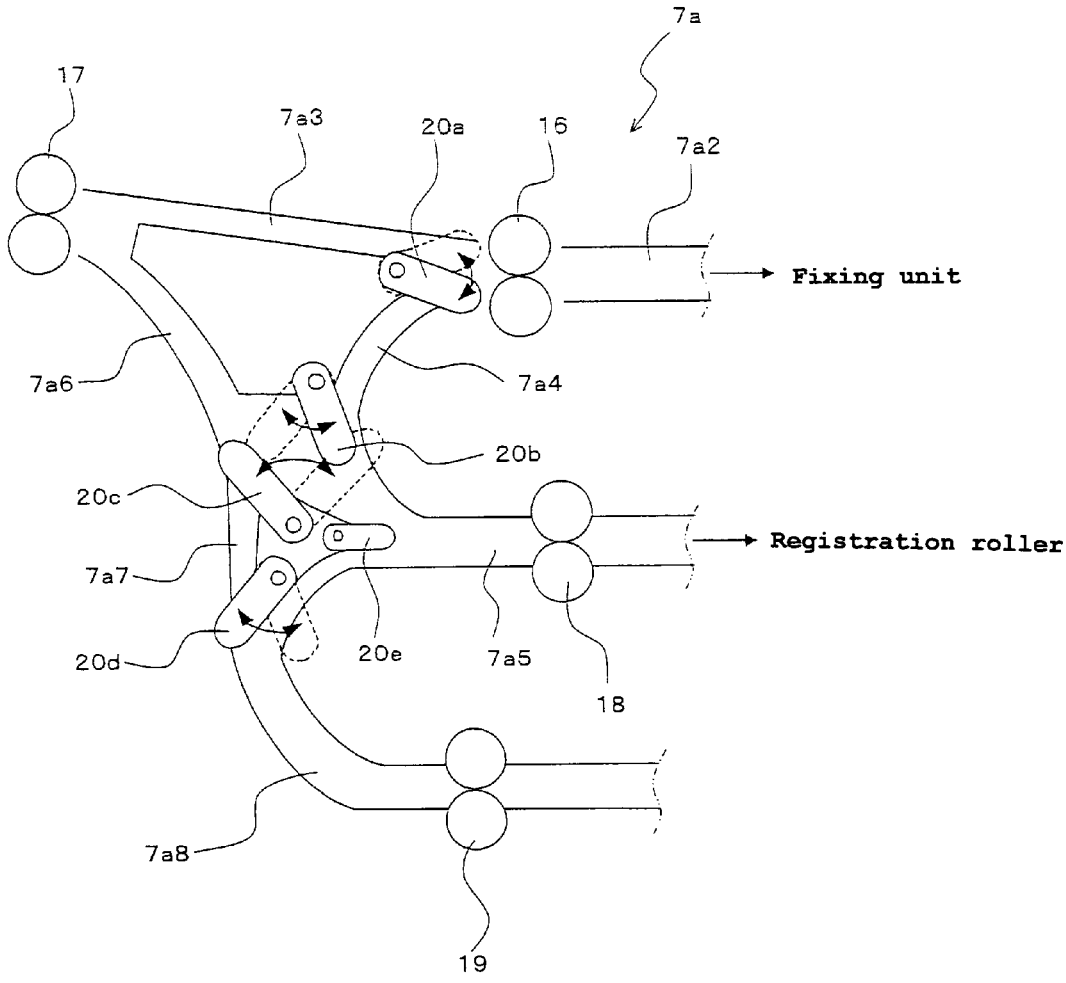
FIG. 4 is a partial detailed view showing the configuration of branched paper feed paths for the paper feed path system and branch guides for connecting these paths.

FIG. 3 is an illustrative view showing the configuration of paper feed paths in the image forming apparatus according to the present embodiment; and FIG. 4 is a partial detailed view showing the configuration of branched paper feed paths in the aforementioned paper feed paths and branch guides for connection therebetween.

As shown in FIGS. 3 and 4, paper feed paths (recording media feed paths) 7*a* are essentially composed of a first paper feed path 7*a*1 extending from paper feed tray 8 to registration roller 15, a second paper feed path 7*a*2 extending from registration roller 15 and passing through transfer device 10 and fixing unit 6 to a conveyance roller 16 on the downstream side, a third paper feed path (first recording media feed path) 7*a*3 extending from conveyance roller 16 to a paper discharge roller (conveyor roller) 17 for discharging paper to paper output tray 9, a fourth paper feed path 7*a*4 for inverting paper P from conveyance roller 16, a fifth paper feed path 7*a*5 connected to fourth paper feed path 7*a*4 and extending to an inversion conveyance roller 18 for re-feeding paper P to registration roller 15, a sixth paper feed path 7*a*6 for conveying paper P in reverse from paper discharge roller 17, a seventh paper feed path 7*a*7 connected to the sixth paper feed path and avoiding entrance to fifth paper feed path 7*a*5 and an eighth paper feed path 7*a*8 connected to seventh paper feed path 7*a*7 and extending to a switchback roller 19.

Here, inside paper feed paths 7*a* a multiple number of paper P can occupy depending on the processing mode. In the present embodiment, eight sheets of paper P may be present at locations (1) to (8) (represented by encircled numerals in the drawing) in paper feed paths 7*a*, as shown in FIG. 3. The number of paper P permissible to be present in the paper feed paths can be changed into any form depending on the paper feed path configuration.

Further, a plurality of branch guides for switching the route of paper P's conveyance by selecting the paper feed paths in accordance with the selected processing mode are arranged at branch points.

As shown in FIG. 4, a branch guide 20*a* that selects connection to third paper feed path 7*a*3 or fourth paper feed path 7*a*4 is pivotally arranged at a point downstream of conveyance roller 16. This branch guide 20*a* is adapted to operate by an unillustrated solenoid.

A branch guide 20*b* that connects fourth paper feed path 7*a*4 with fifth paper feed path 7*a*5 or fifth paper feed path 7*a*5 with sixth paper feed path 7*a*6 is pivotally arranged on the downstream side of fourth paper feed path 7*a*4. This branch guide 20*b* is operated by the elastic force of an unillustrated spring member and the rigidity of paper P.

A branch guide 20*c* that selects connection to fifth paper feed path 7*a*5 or seventh paper feed path 7*a*7 is pivotally arranged on the downstream side of sixth paper feed path 7*a*6. This branch guide 20*c* is adapted to operate by an unillustrated solenoid.

A branch guide 20*d* that connects seventh paper feed path 7*a*7 with eighth paper feed path 7*a*8 or fifth paper feed path 7*a*5 with eighth paper feed path 7*a*8 is pivotally arranged on the downstream side of seventh paper feed path 7*a*7. This branch guide 20*d* is adapted to operate by an unillustrated solenoid.

A branch guide 20*e* for assuring smooth connection from fourth paper feed path 7*a*4 or eighth paper feed path 7*a*8 to fifth paper feed path 7*a*5 is pivotally arranged on the upstream side of fifth paper feed path 7*a*5.

With the thus configured paper feed paths 7*a*, branch guides 20*a* to 20*d* are operated in accordance with the requested processing mode, whereby it is possible to select a conveyance route of paper P corresponding to the processing mode.

Next, the configuration of the developing unit and toner supply device provided for the image forming apparatus according to the present embodiment will be described with reference to the drawings.

Figure 5:
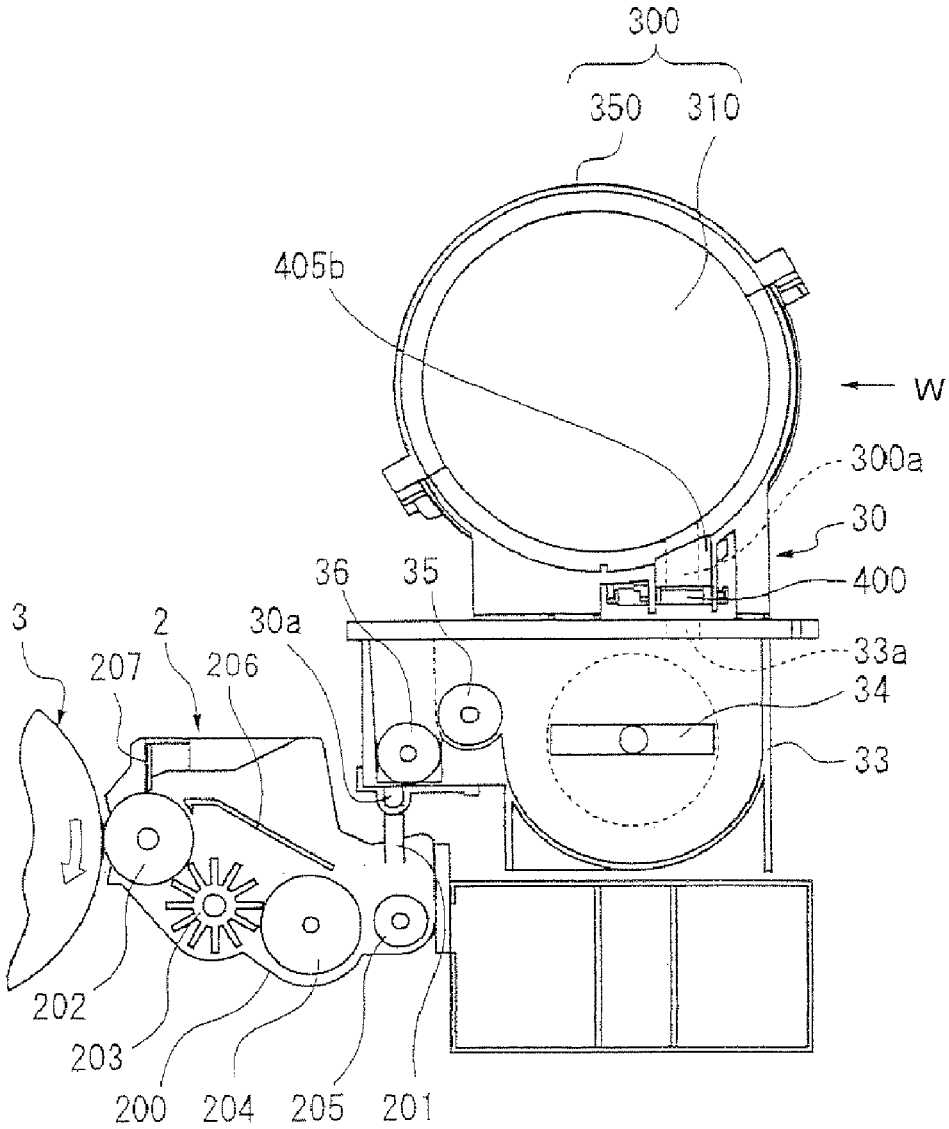
FIG. 5 is an overall sectional side view showing a developing unit and toner supply device provided for the same image forming apparatus.
Figure 6:
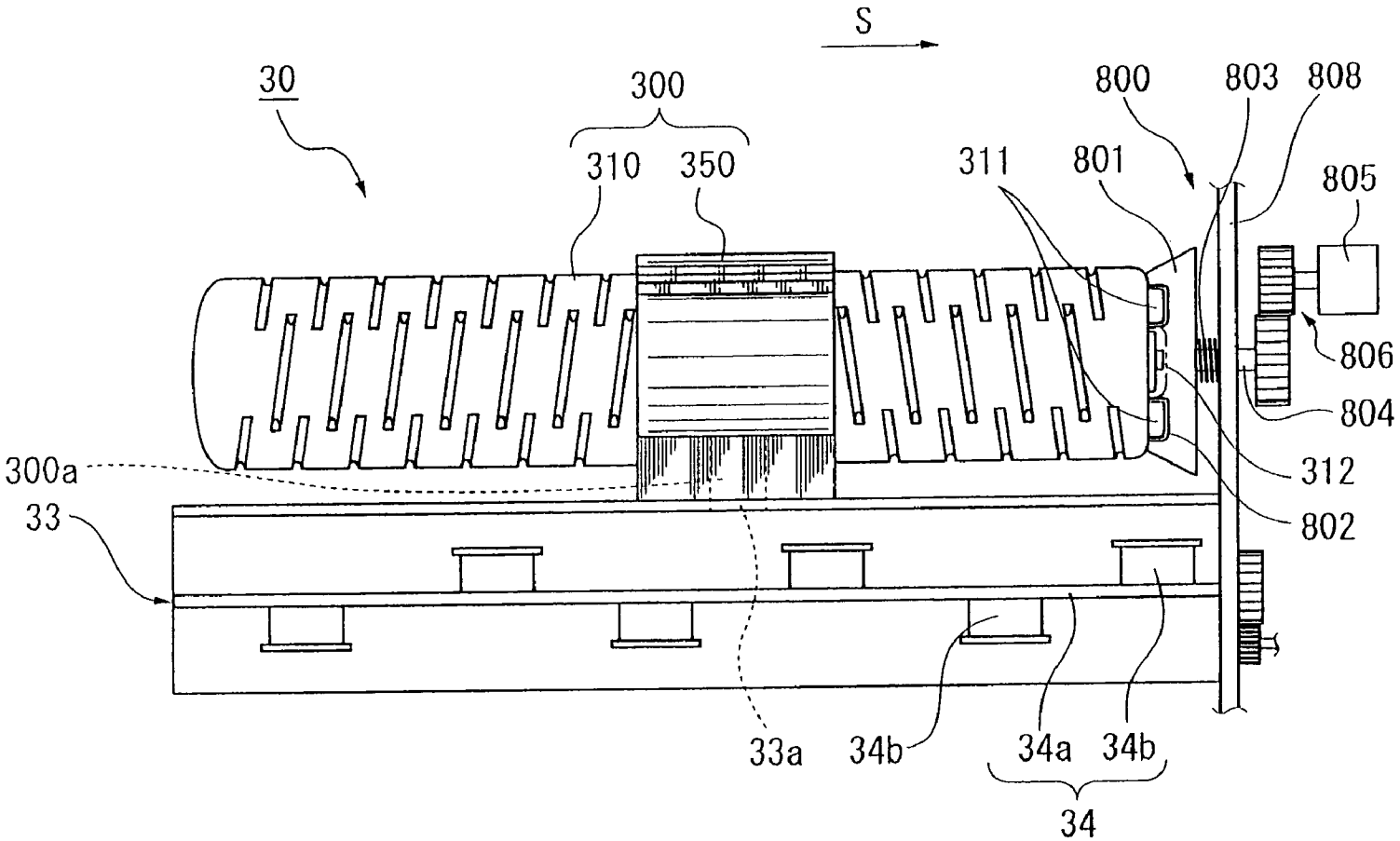
FIG. 6 is an overall front view showing the configuration of the toner supply device, when viewed from the W-direction in FIG. 5.

FIG. 5 is an overall sectional side view showing a developing unit and toner supply device provided for the image forming apparatus according to the present embodiment. FIG. 6 is an overall front view showing the configuration of the toner supply device, viewed in the W-direction in FIG. 5.

As shown in FIG. 5, the exterior of developing unit 2 is formed by a hopper 200, which has a toner input port 201 for receiving toner at a position where the developing unit abuts an opening 30*a* of toner supply device 30 for supplying toner.

Arranged inside hopper 200 are a developing roller 202, a paddle roller 203, a mixing roller 204, a conveying roller 205, a partitioning plate 206 and a doctor 207 as a regulating member.

In hopper 200, the toner that was fed from toner supply device 30 and input through toner input port 201 is conveyed by conveying roller 205 to mixing roller 204, where the toner is mixed with a magnetic carrier to thereby prepare a dual-component developer. This developer as it is being agitated by paddle roller 203 is supplied to developing roller 202 for development of electrostatic latent images and conveyed to the electrostatic latent image supported on photoreceptor drum 3.

The developer supplied to developing roller 202 is regulated as to its amount of supply by doctor 207. The extra developer cut off thereby is recirculated by partitioning plate 206 so that it goes away from doctor 207.

Toner supply device 30 is arranged adjacent to developing unit 2, and temporarily reserves the toner discharged from toner container 300 filled with toner, in intermediate hopper (toner feed device) 33 and then feeds the toner to developing unit 2. In the present embodiment, toner container 300 is configured so that container body 310 charged with toner is rotatably supported by a supporting structure 350.

As shown in FIG. 6, one side end of container body 310 of toner container 300 is coupled to a main body-side coupler 800 arranged on the main body of image forming apparatus 1A.

Main body-side coupler 800 has an approximately disk-shaped joint socket 801 which is rotated by driving force from a drive source 805 such as a motor etc., of image forming apparatus 1A so as to couple this joint socket 801 with container body 310. Describing the coupling of these in further detail, a recessed fitting arrangement 802 for receiving fitting projections 311 and a refill port cap 312 arranged on one side end of container body 310 is provided for joint socket 801. As toner container 300 is moved so that one end of container body 310 where fitting projections 311 and refill port cap 312 are formed advances toward joint socket 801 (in the S-direction shown in FIG. 6), fitting projections 311 and refill port cap 312 fit into recessed fitting arrangement 802 formed in joint socket 801 when toner container 300 is mounted to image forming apparatus 1A. Thus container body 310 is coupled to joint socket 801.

In the state where container body 310 is being coupled to joint socket 801, toner container 300 is set on intermediate hopper 33, and a toner feed aperture (toner feed port) 300*a* formed in supporting structure 350 of container body 310 and an opening 33*a* formed in intermediate hopper 33 are positioned so as to establish communication therebetween.

As shown in FIG. 6, joint socket 801 is attached to a rotary shaft 804 so that its center corresponds to the rotational center of rotary shaft 804 that penetrates through a chassis 808 of image forming apparatus 1A. A spring member 803 such as a compression coil spring or the like is attached on rotary shaft 804 between chassis 808 and joint socket 801. Spring member 803 urges joint socket 801 in such a direction as to bring the socket away from chassis 808. Therefore, in order that toner supply device 30 will press joint socket 801, an unillustrated limiting member is provided so that movement of toner supply device 30 in the direction of attachment is limited.

As described above, in toner supply device 30 mounted to image forming apparatus 1A, the driving force from drive source 805 of image forming apparatus 1A is transmitted to joint socket 801 by way of a speed reducer 806 such as gears etc. and rotary shaft 804, so as to turn this joint socket 801. As a result, container body 310 rotates about the cylinder axis of container body 310 so as to discharge toner from container body 310 and send it out to intermediate hopper 33 through toner feed aperture 300*a* formed in supporting structure 350.

The toner thus sent out to intermediate hopper 33 is agitated therein by an agitator 34 first. Agitator 34 is composed of an agitator shaft 34*a* and agitating vanes 34*b* attached thereto, as shown in FIG. 6. As agitator shaft 34*a* turns, agitating vanes 34*b* rotate about agitator shaft 34*a* to thereby agitate the toner in intermediate hopper 33 that has been fed from toner container 300. The toner thus agitated by agitator 34 is sent by the agitating action of agitator 34 and conveyed to the feed roller 36 (FIG. 5) side via conveying roller 35 (FIG. 5). Feed roller 36 sends out the toner that has been conveyed from agitator 34 via conveying roller 35 to opening 30*a* that is formed at the position where intermediate hopper 33 abuts developing unit 2, to thereby supply the toner to developing unit 2.

Provided on the bottom side (the under side when toner container 300 is mounted on image forming apparatus 1A) of supporting structure 350 of toner container 300 is a shutter opening and closing mechanism 400 for opening and closing toner feed aperture 300*a* through which toner from toner container 300 is discharged out of supporting structure 350, as shown in FIG. 5.

Specifically, as toner feed aperture 300*a* of supporting structure 350 is released by shutter opening and closing mechanism 400, communication between toner feed aperture 300*a* and opening 33*a* provided for intermediate hopper 33 is established, so that the toner discharged from toner container 300 is supplied to intermediate hopper 33.

Next, the configuration of toner container 300 in the present embodiment will be described in detail with reference to the drawings.

Figure 7:
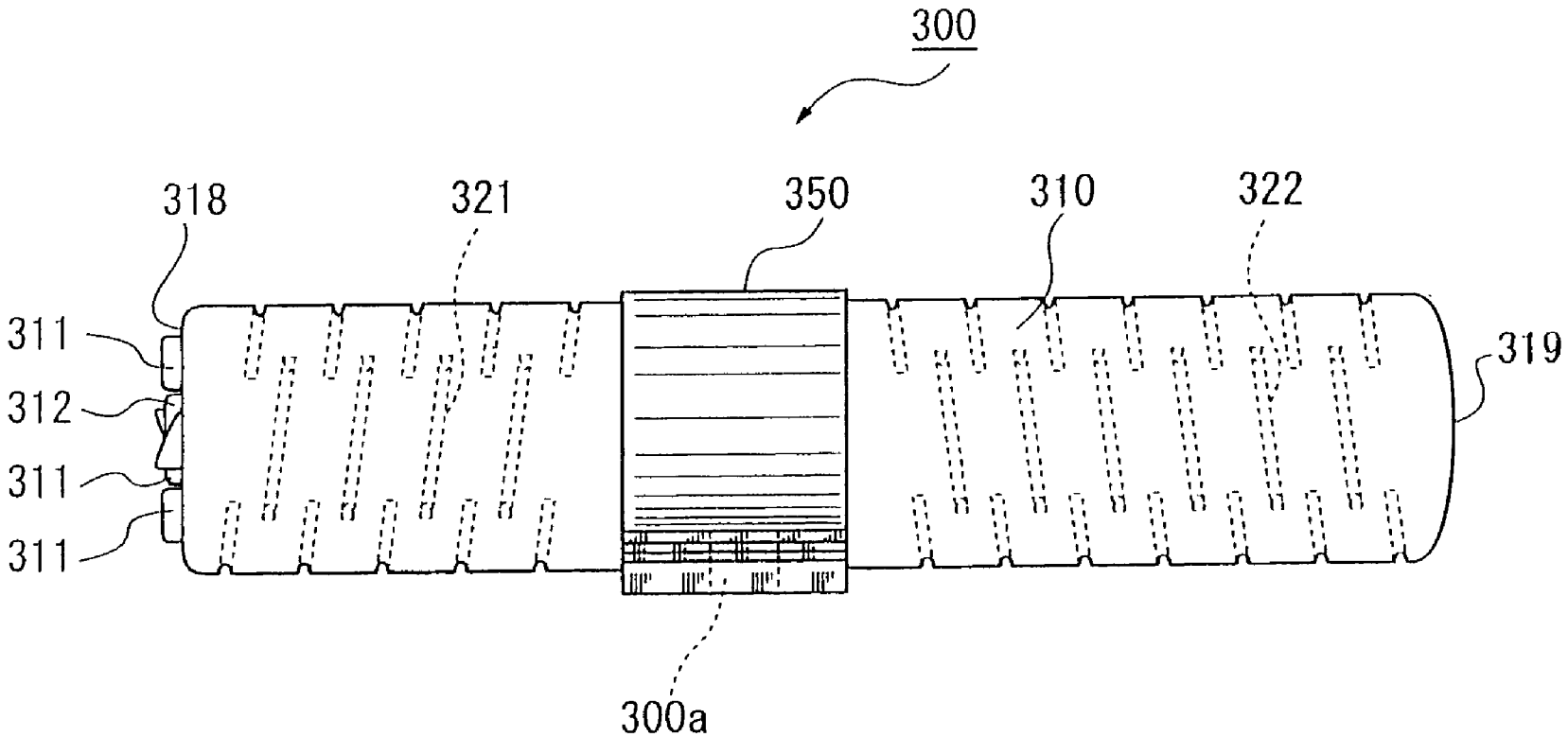
FIG. 7 is a front view showing a toner container according to the present embodiment.
Figure 8:
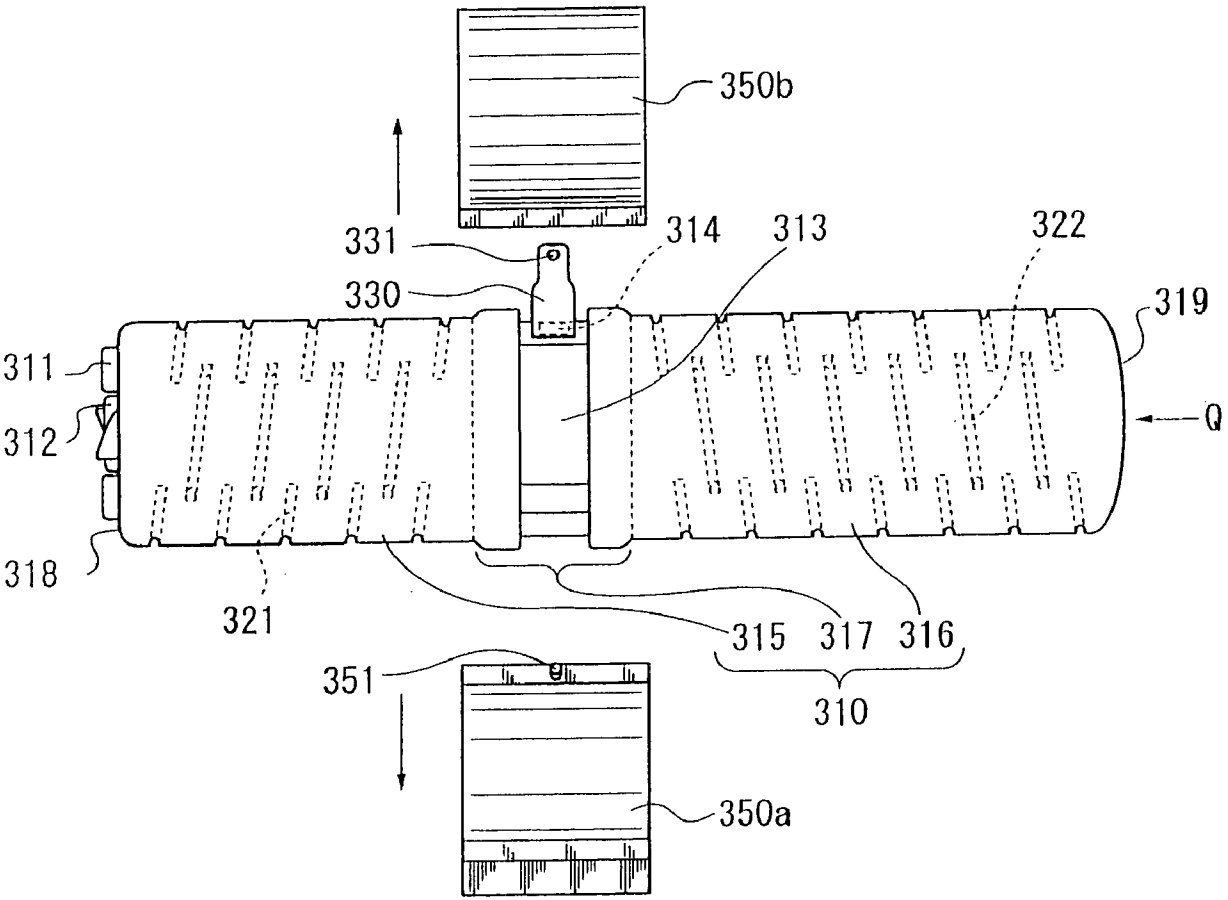
FIG. 8 is an illustrative view showing how the toner container is assembled.
Figure 9:
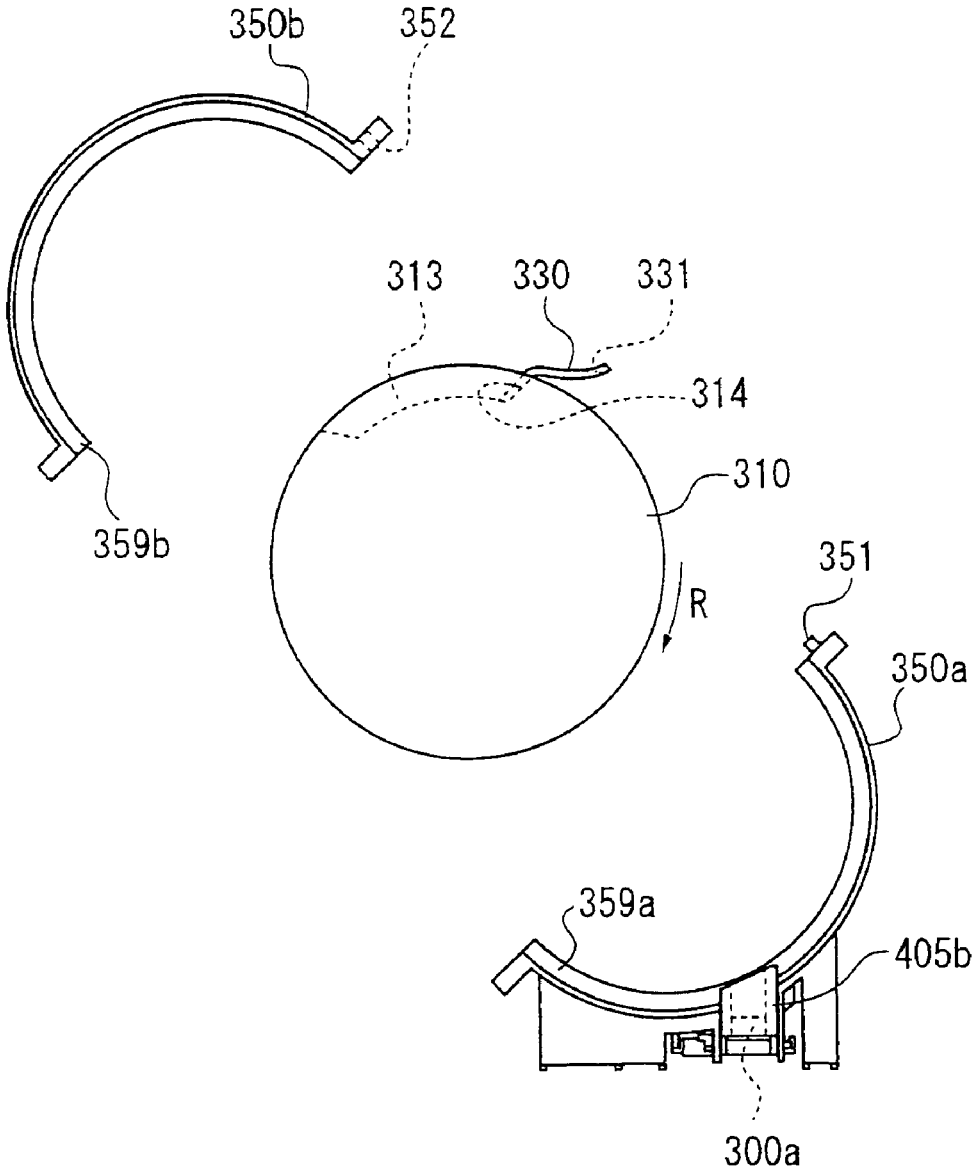
FIG. 9 is a side view, viewed in the Q-direction in FIG. 8.

FIG. 7 is a front view showing a toner container according to the present embodiment; FIG. 8 is a front view showing how the toner container is assembled; and FIG. 9 is a side view, viewed in the Q-direction in FIG. 8.

Here, FIGS. 7 and 8 are front views, viewed in the direction opposite to the W-direction in FIG. 5.

Figure 10:
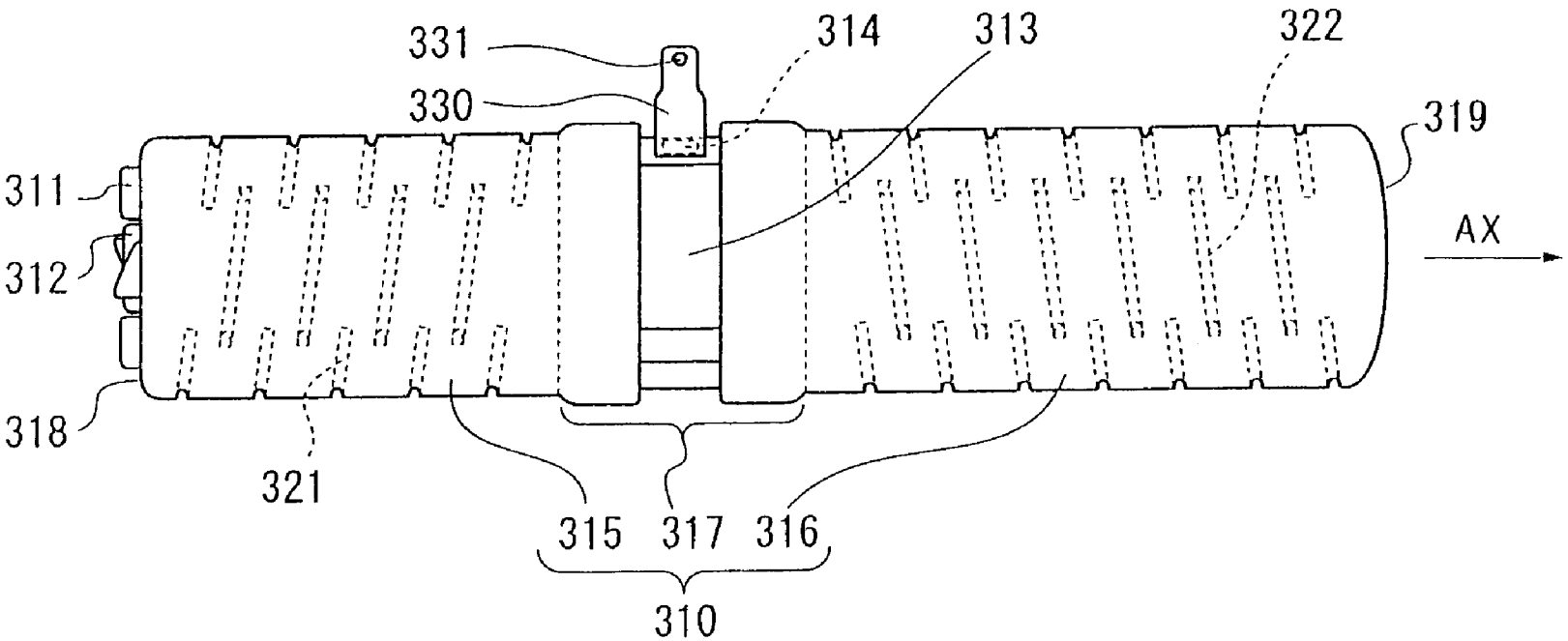
FIG. 10 is a front view of the container body constituting the same toner container.
Figure 11A:
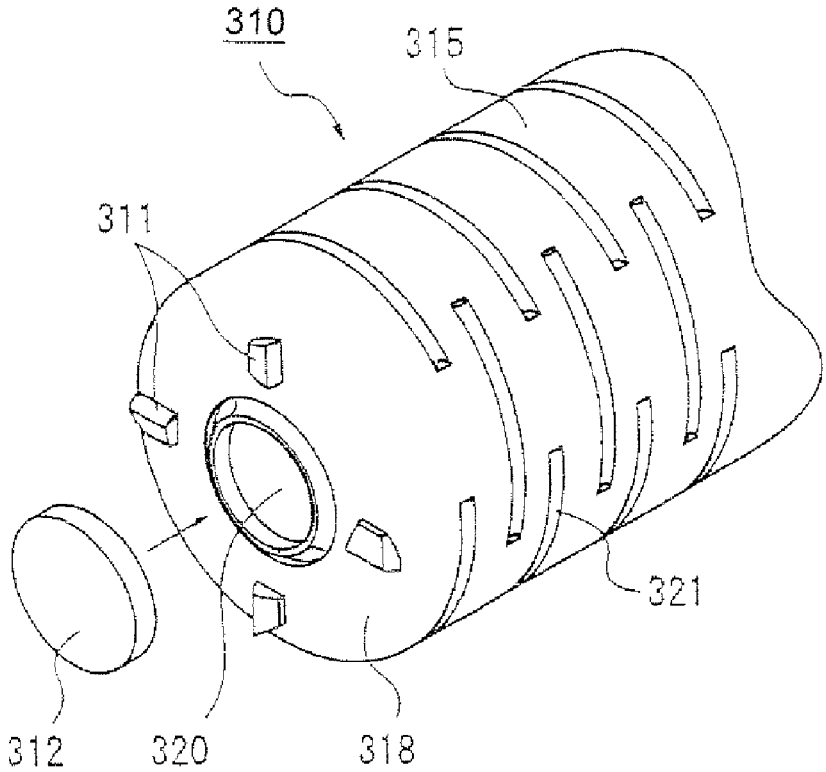
FIG. 11A is a perspective view showing the end part of the container body, at the side coupled to the main body-side coupler.
Figure 11B:
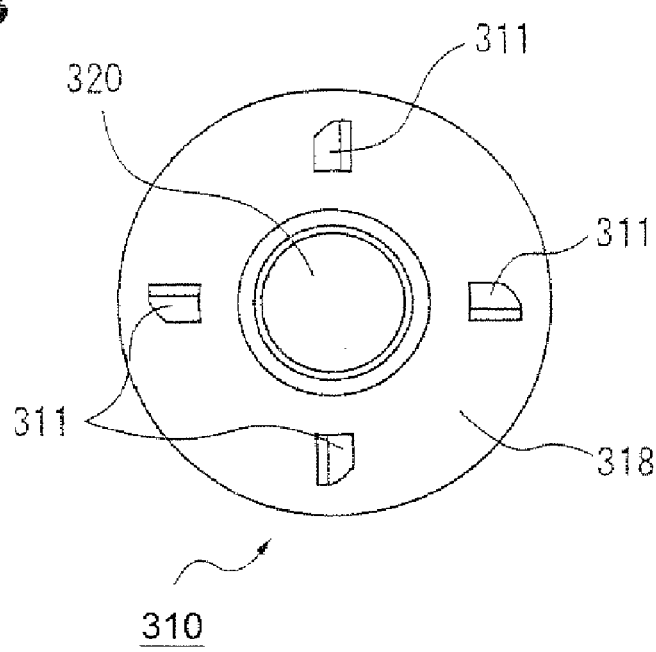
FIG. 11B is a front view of the same end part of the container body.
Figure 12:
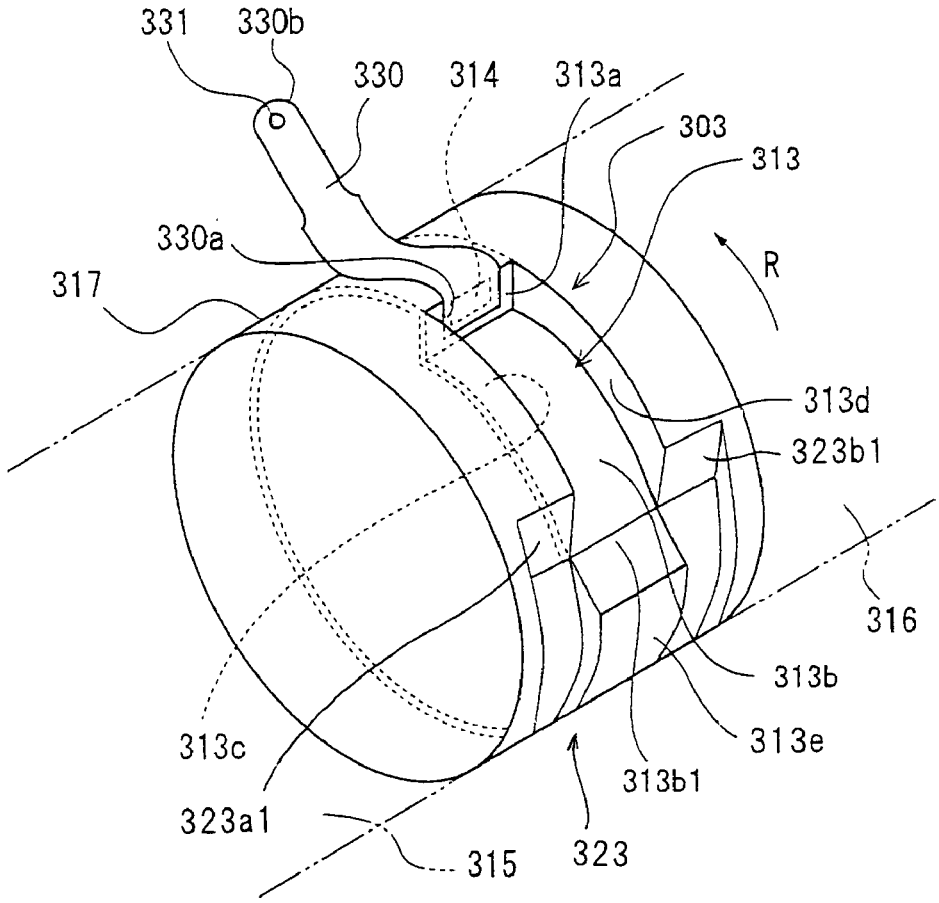
FIG. 12 is a partial perspective view showing the configuration around a toner discharge aperture of the container body.
Figures 13A, 13B, 13C:
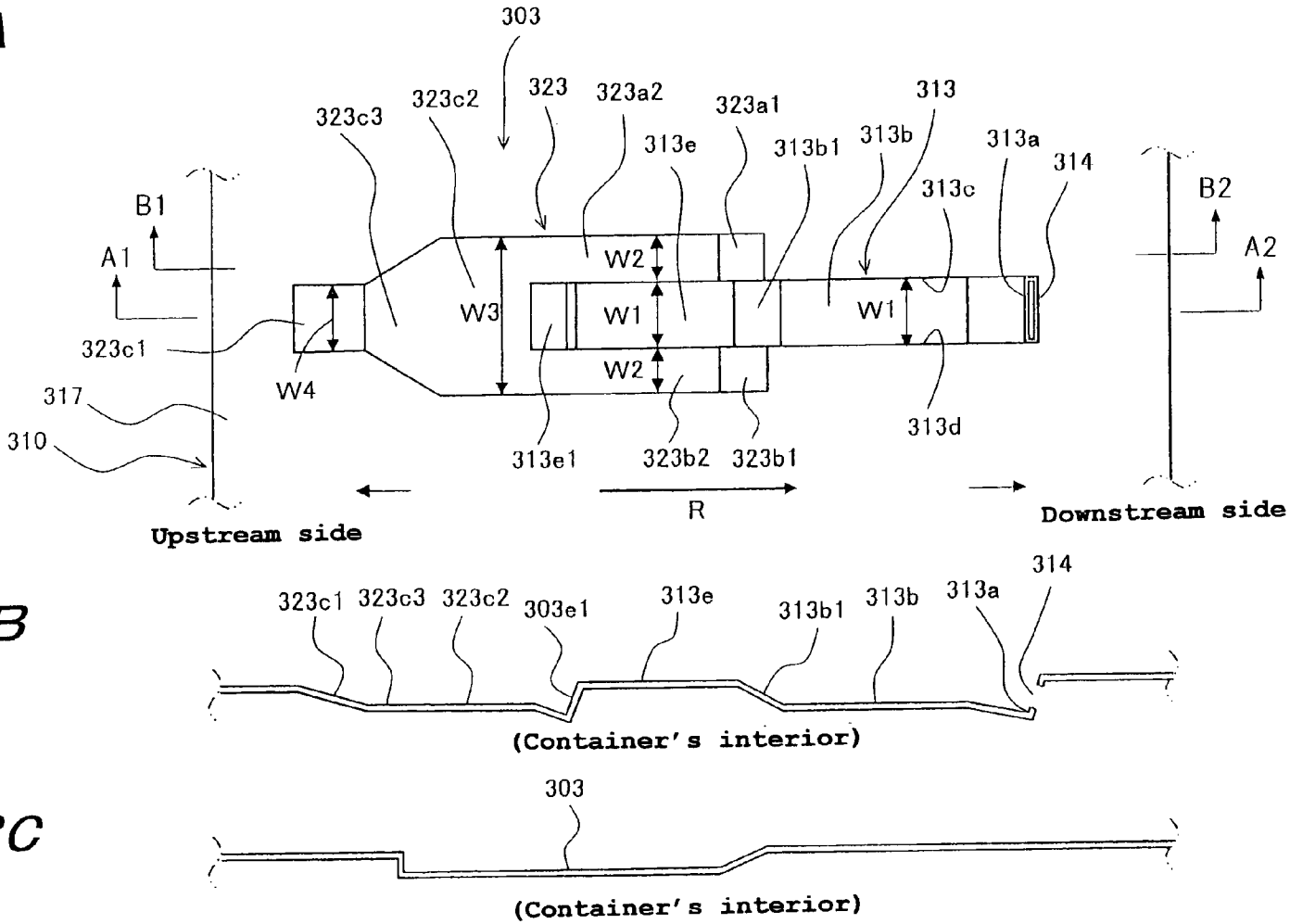
FIG. 13A is a development showing the configuration of a toner feed recess formed around the toner discharge aperture.
FIG. 13B is a sectional view, cut along a plane A1-A2 in FIG. 13A.
FIG. 13C is a sectional view, cut along a plane B1-B2 in FIG. 13A.
Figure 14A:
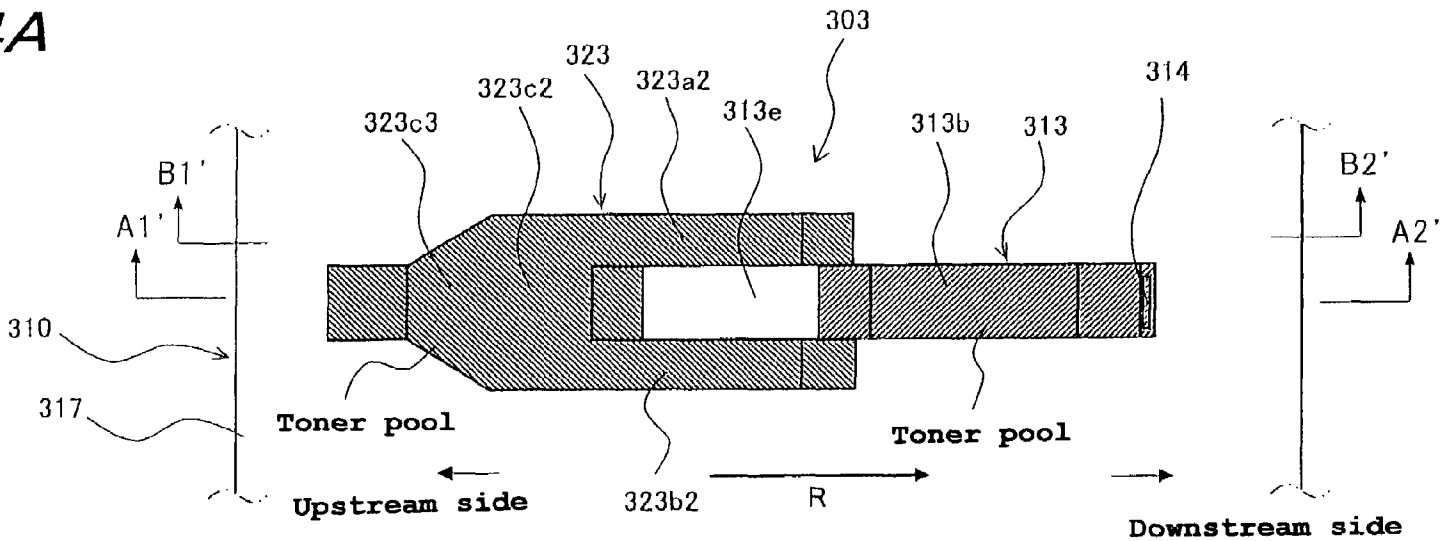
FIG. 14A is an illustrative view showing a state in which toner is pooled in the toner feed recess.
Figure 14B:
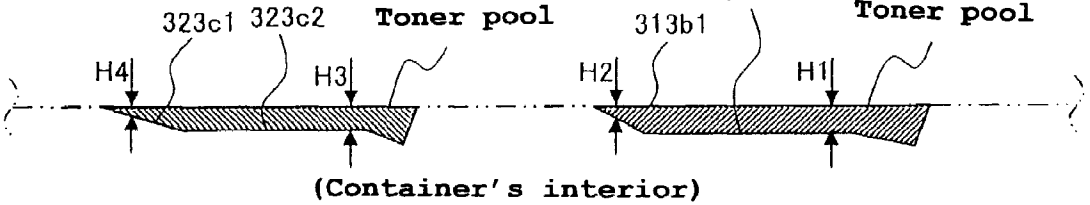
FIG. 14B is a sectional view, cut along a plane A1'-A2' in FIG. 14A.
Figure 14C:
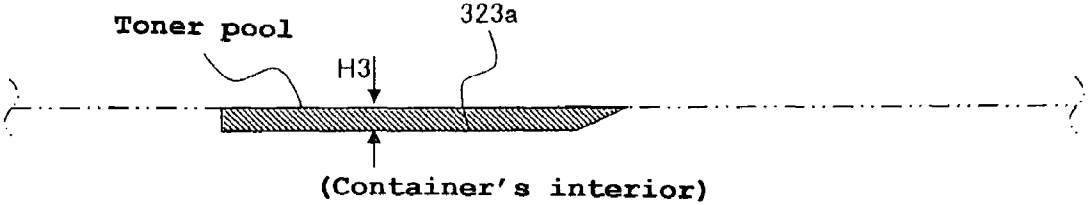
FIG. 14C is a sectional view, cut along a plane B1'-B2' in FIG. 14A.
Figure 15A:
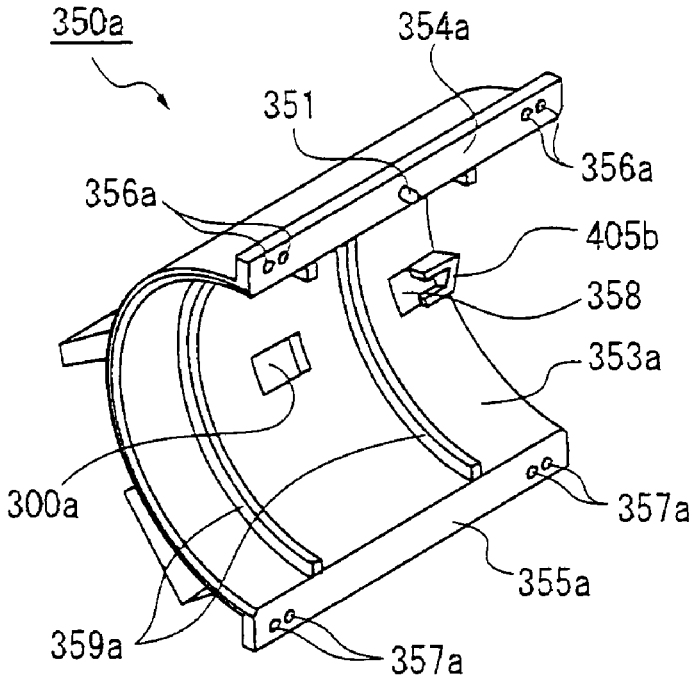
FIG. 15A is a perspective view showing the configuration of a first supporting member of a supporting structure according to the present embodiment.
Figure 15B:
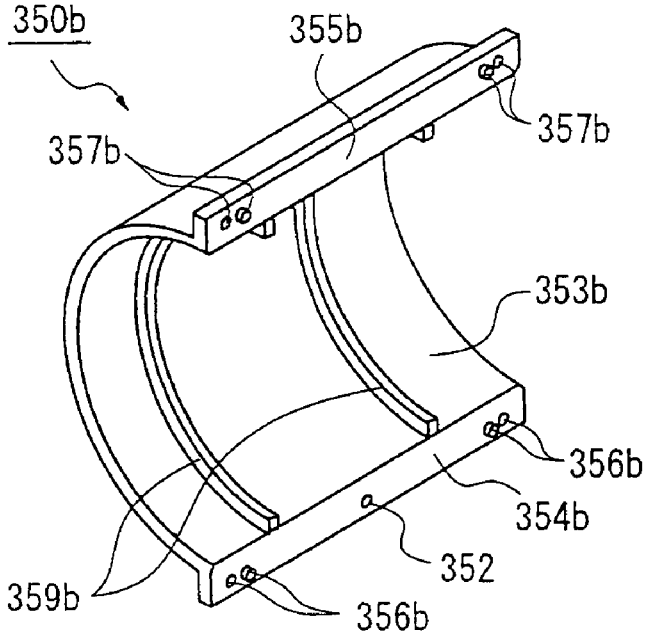
FIG. 15B is a perspective view showing the configuration of a second supporting member of the supporting structure.
Figure 16A:
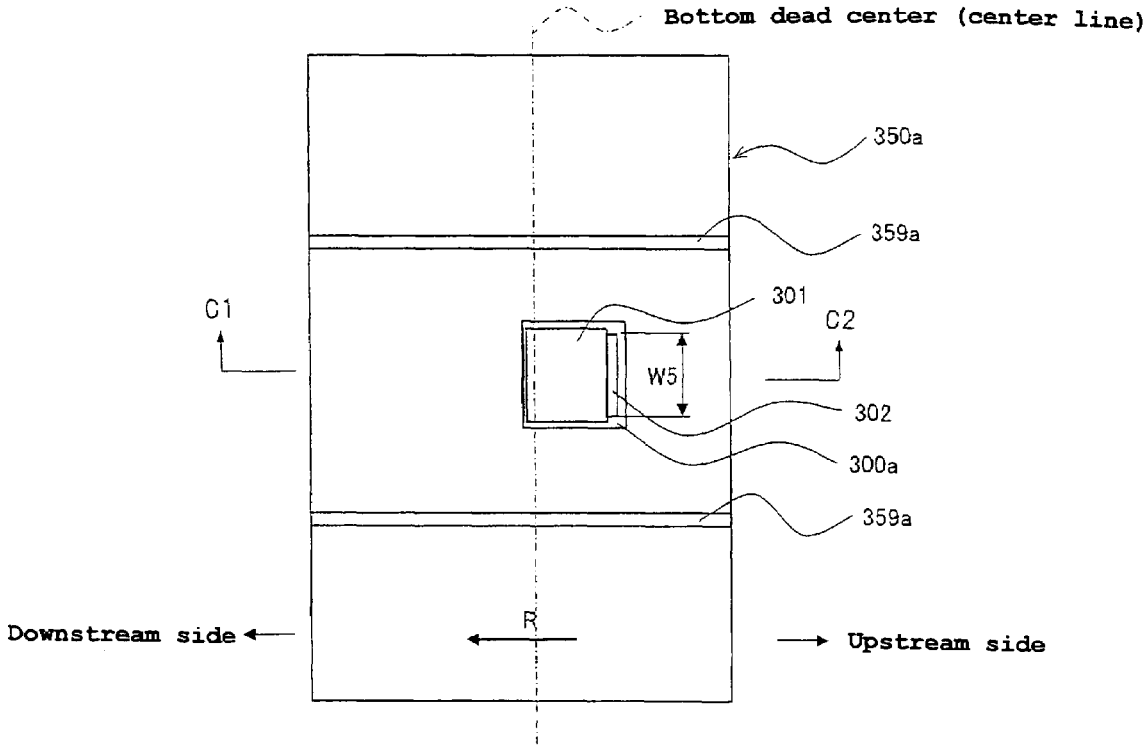
FIG. 16A is a plan view showing the configuration of the toner feed aperture of the first supporting member.
Figure 16B:
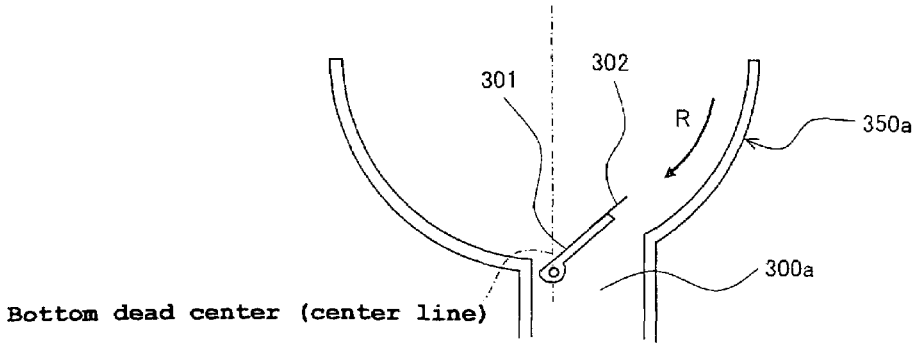
FIG. 16B is a sectional view, cut along a plane C1-C2 in FIG. 16A.

FIG. 10 is a front view of the container body; FIG. 11A is a perspective view showing the end part of the container body, at the side coupled to the main body-side coupler; FIG. 11B is a front view of the same end part of the container body; FIG. 12 is a partial perspective view showing the configuration around a toner discharge aperture of the container body; FIG. 13A is a development showing the configuration of a toner feed recess formed around the toner discharge aperture; FIG. 13B is a sectional view cut along a plane A1-A2 in FIG. 13A; FIG. 13C is a sectional view cut along a plane B1-B2 in FIG. 13A; FIG. 14A is an illustrative view showing a state in which toner is pooled in the toner feed recess; FIG. 14B is a sectional view cut along a plane A1'-A2' in FIG. 14A; FIG. 14C is a sectional view cut along a plane B1'-B2' in FIG. 14A; FIG. 15A is a perspective view showing the configuration of a first supporting member of a supporting structure according to the present embodiment; FIG. 15B is a perspective view showing the configuration of a second supporting member of the supporting structure; FIG. 16A is a plan view showing the configuration of the toner feed aperture of the first supporting member; and FIG. 16B is a sectional view, cut along a plane C1-C2 in FIG. 16A.

As described already, toner container 300 (FIG. 7) has a configuration including approximately cylindrical container body 310 and supporting structure 350. As shown in FIGS. 8 and 9, container body 310 is rotatably supported by supporting structure 350 assembled of approximately semi-cylindrical first and second supporting members 350*a* and 350*b*.

Container body 310 is essentially composed of, as shown in FIG. 10, three approximately cylindrical portions, namely, first container part 315, second container part 316 and third container part 317. Each of these container parts is integrally formed by blow molding of a synthetic resin such as polyphenylene ether, polyethylene or the like, for example.

The third container part 317 is disposed between first and second container parts 315 and 316. The first and second container parts 315 and 316 have bottom portions 318 and 319, respectively, which constitute the bottoms of cylindrical container body 310.

Container body 310 has a toner storing portion for storing toner therein. Formed on the outer peripheral surface at the approximate center of third container part 317 of container body 310 is a toner feed recess 303, depressed radially inwards. At one end of this toner feed recess 303 there is a toner discharge aperture (toner discharge port) 314 (FIG. 8) for discharging toner from toner container 310, as will be described below.

Container body 310 is rotated about the cylinder axis AX extending in the longitudinal direction of container body 310 whilst third container part 317 of the thus constructed container body 310 is being supported by supporting structure 350, so that toner is discharged from toner discharge aperture 314 to toner feed recess 303 which is formed on the outer peripheral surface of toner container 310. Here, the Q-direction in FIG. 8 is the same as the direction in which cylinder axis AX extends.

First container part 315 (FIGS. 8 and 10) is arranged on the side where the aforementioned main body-side coupler 800 (see FIG. 6) of the image forming apparatus is located. Accordingly, bottom portion 318 of first container part 315 is formed with four fitting projections 311 that project from bottom 318 as a coupler to be coupled with main body-side coupler 800, as shown in FIGS. 11A and 11B.

These fitting projections 311 are arranged so that opposing fitting projections 311 are positioned essentially point symmetrically about the center of bottom portion 318 or the cylinder axis AX of approximately cylindrical container body 310. Toner supply device 30 is attached to main body-side coupler 800 of image forming apparatus 1A by means of these fitting projections 311, and container body 310 receives driving force from a drive source from image forming apparatus 1A and rotates about cylinder axis AX.

Bottom portion 318 further has an opening penetrating therethrough as a toner supply port 320, to which refill port cap 312 is removably fitted. Toner refill port 320 is provided to refill container body 310 of toner container 300 with toner and is formed in the center of bottom portion 318 in a circular shape centered at the aforementioned cylinder axis.

Refill port cap 312 totally covers toner refill port 320 and seals it. This refill port cap 312 is fitted to toner refill port 320 in such a manner that it will not come off due to rotation of container body 310 about the cylinder axis. Further, refill port cap 312 is adapted to be detached from toner refill port 320 when toner is loaded from toner refill port 320 into container body 310.

Formed on the inner surface of the peripheral side of first container part 315 (to be referred to as inner peripheral surface) are a plurality of conveyor elements 321 in order to convey the toner inside container body 310 of toner container 300 along the direction of the cylinder axis AX. These conveyor elements 321 are formed projectively from the inner peripheral surface toward the cylinder axis AX (radially inwards of container body 310), at regular intervals with respect to the peripheral direction and the cylinder axis direction of first container part 315. Conveyor elements 321 are arranged parallel to each other.

Conveyor elements 321 are formed being inclined at a predetermined angle with the direction of a line that lies on the inner peripheral surface and is perpendicular to the cylinder axis AX of container body 310, in order to convey toner from the bottom portion 318 side toward third container part 317 (FIG. 10). In other words, each of these conveyor elements 321 is formed so that its downstream end is located closer to third container part 317 having toner discharge aperture 314 (FIG. 8) than its upstream end, with respect to the direction of rotation of container body 310 about the cylinder axis.

Second container part 316 is formed with bottom portion 319 of container body 310 and arranged in approximately cylindrical container body 310 at the end that is opposite to the side where main body-side coupler 800 (see FIG. 6) provided for image forming apparatus 1A is laid out, as shown in FIG. 10. The inside diameter of second container part 316 is formed so as to be equal to that of first container part 315.

Formed on the inner peripheral surface of second container part 316 are a plurality of conveyor elements 322 in order to convey the toner inside container body 310 along the direction of the cylinder axis AX. These convey or elements 322 are formed projectively from the inner peripheral surface toward the cylinder axis, at regular intervals with respect to the peripheral direction and the direction of cylinder axis AX of second container part 316. Conveyor elements 322 are arranged parallel to each other.

Conveyor elements 322 are formed being inclined at a predetermined angle with the direction of a line that lies on the inner peripheral surface and is perpendicular to the cylinder axis AX of container body 310, in order to convey toner from the bottom portion 319 side toward third container part 317. In other words, each of these conveyor elements 322 is formed so that its downstream end is located closer to third container part 317 having toner discharge aperture 314 than its upstream end, with respect to the direction of rotation of container body 310 about the cylinder axis.

As described heretofore, since container body 310 of toner container 300 of the present embodiment has third container part 317 between first container part 315 and second container part 316, the inclination of conveyor elements 322 formed in second container part 316 is formed opposing that of conveyor elements 321 formed in first container part 315. As a result, as container body 310 rotates about the cylinder axis (in the R-direction in FIG. 9), the toner stored in the first container part 315 and the toner stored in the second container part 316 move towards third container part 317, being guided by conveyor elements 321 and 322 from bottom portions 318 and 319 of container body 310, respectively.

As shown in FIGS. 8 and 10, third container part 317 is the portion that is rotatably supported by supporting structure 350, and its inside diameter is formed marginally greater than that of first and second container parts 315 and 316. With this configuration, the toner conveyed from the first and second container parts 315 and 316 can be correctly conveyed and brought down into third container part 317, so that it is possible to constantly hold a uniform amount of toner inside third container part 317.

Accordingly, even when container body 310 stops rotating, third container part 317 holds a predetermined amount of toner, so that it is possible to give a stable supply of toner immediately after container body 310 is restarted to rotate. Further, since a fixed amount of toner can be held if the remaining amount of toner in container body 310 has become lower, it is possible to make stable supply of toner over a long period.

As shown in FIG. 12, third container part 317 is formed with toner feed recess (toner pool) 303 that has a predetermined width with respect to the cylinder axis AX of container body 310 and extends on the outer peripheral surface of container body 310 one round on the outer peripheral surface in the rotational direction of container body 310.

This toner feed recess 303 is formed so that it sinks radially inwards from the outer surface of the peripheral side of third container part 317 (to be mentioned hereinbelow as the outer peripheral surface). The thus configured toner feed recess 303 serves as a space for temporarily holding the toner discharged from container body 310 and is also used as a space for delivering toner from toner feed recess 303 to toner feed aperture 300*a* (FIG. 7) formed in supporting structure 350 (FIG. 7).

Now, the characteristic configuration of toner feed recess 303 according to the present embodiment will be described with reference to the drawings.

As shown in FIG. 13A, toner feed recess 303 is formed contiguously from toner discharge aperture 314, toward the upstream side with respect to the rotational direction R of container body 310.

Toner feed recess 303 is extended along the rotational direction R.

This toner feed recess 303 is composed of a first toner feed hollow 313 that is extended upstream from toner discharge aperture 314 with respect to the rotational direction R of container body 310 and a second toner feed hollow 323 that is further extended to the upstream side continuously from the vicinity of a slope (at the upstream side end) 313*b*1 of the first toner feed hollow 313.

As shown in FIGS. 12, 13A and 13B, first toner feed hollow 313 is defined by an end wall portion 313*a*, a bottom wall portion 313*b*, a first side wall portion 313*c* and a second side wall portion 313*d*, extending parallel and to the upstream side with respect to the rotational direction R of container body 310.

End wall portion 313*a* is arranged at the downstream end of first toner feed hollow 313 with respect to the rotational direction R of container body 310 and defined as a plane that is approximately perpendicularly to the outer peripheral surface of first toner feed hollow 313 and extends in the direction along the cylinder axis AX. This end wall portion 313*a* is formed with toner discharge aperture 314. Toner discharge aperture 314 is formed as an opening connected to the interior of container body 310 in order to discharge toner stored in container body 310 into first toner feed hollow 313.

Bottom wall portion 313*b* has a surface opening width (the distance along the cylinder axis AX of the opening of the surface (flat plane) of the indented portion) W1 and is extended in the rotational direction R so that its downstream end with respect to the rotational direction R is connected to end wall portion 313*a* while in its upstream end a slope 313*b*1 is formed toward outer peripheral surface 313*e* of third container part 317 so that the hollow becomes continuously shallower. That is, bottom wall portion 313*b* is formed roughly parallel to the outer peripheral surface in the area other than near slope 313*b*1, so that the outer peripheral surface of third container part 317 is sunken inwards of the container. In the present embodiment, bottom wall portion 313*b*, slope 313*b*1 and outer peripheral surface 313*e* all have the same width W1.

First side wall portion 313*c* and second side wall portion 313*d* are formed approximately parallel to each other, at both sides, with respect to the direction of cylinder axis AX, of bottom wall portion 313*b*. First sidewall portion 313*c* and second side wall portion 313*d* are formed perpendicularly to the outer peripheral surface of first toner feed hollow 313 and bottom wall portion 313*b*.

Further, first side wall portion 313*c* and second side wall portion 313*d* are connected, at their downstream ends with respect to the rotational direction R of container body 310, to end wall portion 313*a* and also connected at their upstream ends to outer peripheral surface 313*e* of third container part 317.

Further, first side wall portion 313*c* and second side wall portion 313*d* are connected, at their upstream side and downstream side with respect to the rotational direction R, to the outer peripheral surface of third container part 317.

As shown in FIG. 13A, second toner feed hollow 323 is a hollow having a squared U-shape (viewed from top) with its opening directed downwards with respect to the rotational direction R.

Second toner feed hollow 323 is composed of two slopes 323*a*1 and 323*b*1, two bottom wall portions 323*a*2 and 323*b*2, a bottom wall portion 323*c*2, upstream end portion 323*c*3 and a slope 323*c*1, all these arranged in the order mentioned from the downstream side to the upstream side with respect to the rotational direction R. That is, slopes 323*a*1 and 323*b*1 are connected at their upstream side, with respect to the rotational direction R, to bottom wall portions 323*a*2 and 323*b*2, respectively. These bottom wall portions 323*a*2 and 323*b*2 are connected at their upstream side with respect to the rotational direction R, to common bottom wall portion 323*c*2. Bottom wall portion 323*c*2 is connected to an upstream end portion 323*c*3 whose width, with respect to the direction along cylinder axis AX, becomes gradually smaller from both sides at a constant rate as it goes to the upstream side with respect to the rotational direction R. The upstream end portion 323*c*3 is connected on its upstream side with respect to the rotational direction R, to a slope 323*c*1.

All the surface opening widths of slopes 323*a*1 and 323*b*1 and bottom wall portions 323*a*2 and 323*b*2 along the direction of cylinder axis AX are W2. The surface opening widths of bottom wall portions 323*c*2 and slope 323*c*1 along the direction of cylinder axis AX are W3 and W4, respectively.

Slopes 323*a*1 and 323*b*1 are formed so that their depths of the hollows become greater from the outer peripheral surface of third container part 317 toward the upstream side with respect to the rotational direction R of container part 310. Slopes 323*a*1 and 323*b*1 are connected on their upstream side with respect to the rotational direction R to bottom wall portions 323*a*2 and 323*b*2, respectively.

These two slopes 323*a*1 and 323*b*1 are arranged so as to put slope 313*b*1 on the first toner feed hollow 313's side therebetween, with respect to the direction of cylinder axis AX. These two slopes 323*a*1 and 323*b*1 (FIG. 13A) of the present embodiment are arranged so as to be continuous to, at least, part of slope 313*b*1, so that these slopes 323*a*1, 323*b*1 and slope 313*b*1 establish the continuity between the hollow space of first toner feed hollow 313 and the hollow space of second toner feed hollow 323. However, the structure for assuring the continuity between the hollowed spaces of first and second toner feed hollows 313 and 323 is not limited to the above configuration. That is, it is possible to establish this continuity by arranging the spaces defined by bottom wall portion 313*b*, slope 313*b*1, slopes 323*a*1 and 323*b*1, bottom wall portions 323*a*2 and 323*b*2, in arbitrary combination. FIG. 12 shows a case where the downstream end of slope 313*b*1 and the upstream ends of slopes 323*a*1 and 323*b*1, with respect to the rotational direction R, meet.

Bottom wall portions 323*a*2 and 323*b*2 have the same surface opening width W2, and are extended in the rotational direction R, approximately parallel to each other with outer peripheral surface 313*e* continuously located therebetween. The upstream ends, with respect to the rotational direction R, of bottom wall portions 323*a*2 and 323*b*2 are connected to bottom wall portion 323*c*2, at the position of the upstream end of slope 313*e*1 that is formed contiguously to and on the upstream side, with respect to the rotational direction R, of outer peripheral surface 313*e*. It should be noted that a configuration with either one of bottom wall portions 323*a*2 and 323*b*2 omitted is also effective.

Bottom wall portion 323*c*2 is extended upstream with respect to the rotational direction R, having a surface opening width W3 (corresponding to the surface opening width of second toner feed hollow 323) which is the sum of W1 (corresponding to the surface opening width of first toner feed hollow 313), the width of outer peripheral surface 313*e* and two times of W2, the surface opening width of bottom wall portions 323*a*2 and 323*b*2.

Upstream end portion 323*c*3 of bottom wall portion 323*c*2 is formed so that it becomes narrower toward the upstream side with respect to the rotational direction R. Further, Upstream end portion 323*c*3 is connected at its upstream side, with respect to the rotational direction R, to slope 323*c*1.

Slope 323*c*1 is formed so that its hollow depth becomes smaller towards the upstream side with respect to the rotational direction R of container body 310.

W4, the surface opening width of slope 323*c*1 is approximately equal to W1, the width of outer peripheral surface 313*e*, i.e., the surface opening width of first toner feed hollow 313.

Since first toner feed hollow 313 and second toner feed hollow 323 are thus formed, the toner discharged from toner discharge aperture 314 of container body 310 is temporarily reserved in first toner feed hollow 313 and second toner feed hollow 323, as shown in FIGS. 14A to 14C.

As shown in FIG. 14B, first toner feed hollow 313 is formed so that its depth becomes smaller from H1 to H2 from bottom wall portion 313*b* toward slope 313*b*1.

In other words, since the surface opening width W1 of first toner feed hollow 313 is essentially constant, the vertical sectional area (on the plane including cylinder axis AX) of the opening of first toner feed hollow 313, perpendicular to the rotational direction R, becomes smaller from the toner discharge aperture 314 side toward the slope 313*b*1's upstream end with respect to the rotational direction R.

As shown in FIGS. 14B and 14C, second toner feed hollow 323 is formed so that its depth is constantly H3, ranging from bottom wall portion 323*a*2 to bottom wall portion 323*c*2.

Also, second toner feed hollow 323 is formed so that its depth becomes smaller from H3 to H4 from bottom wall portion 323*c*2 toward slope 323*c*1 as shown in FIG. 14B.

In other words, the vertical sectional area (on the plane including cylinder axis AX) of the opening of second toner feed hollow 323, perpendicular to the rotational direction R, becomes smaller from bottom wall portion 323*c*2 toward slope 323*c*1's upstream end with respect to the rotational direction R.

In bottom wall portion 323*c*2, since the hollow (second hollow) of upstream end portion 323*c*3 is formed so that its width becomes smaller toward the upstream side with respect to the rotational direction R, the vertical sectional area of the opening tends to reduce greatly.

The surface opening width W1 of the hollow (the first hollow) in first toner feed hollow 313 is set to be approximately equal to the opening width of toner feed aperture 300*a* formed in first supporting member 350*a* (FIG. 14B).

Also, the surface opening width W4 of the hollow (the second hollow) in slope 323*c*1 of second toner feed hollow 323 is set to be approximately equal to the opening width of toner feed aperture 300*a* formed in first supporting member 350*a* (FIG. 14B).

As described above, since first toner feed hollow 313 and second toner feed hollow 323 are formed in a depressed configuration on the outer peripheral surface of third container part 317, it is possible to reduce the contact surface between third container part 317 and supporting structure 350 when container body 310 is rotated (FIG. 8). As a result, the friction between supporting structure 350 and container body 310 during rotation of container body 310 can be reduced so as to realize smooth rotation of container body 310 of toner container 300.

Further, third container part 317 is formed with an enclosing seal 330 as a sealing element for bonding and sealing toner discharge aperture 314 provided in first toner feed hollow 313, as shown in FIG. 12. As shown in FIGS. 9 and 12, enclosing seal 330 is formed in an approximate arc shape with a predetermined length in the peripheral direction of container body 310 and arranged along the end face on which toner discharge aperture 314 of container body 310 is formed.

One end 330*a* of enclosing seal 330 is bonded to toner discharge aperture 314 so as to seal off the toner discharge aperture 314 of first toner feed hollow 313. On the other hand, the other end 330*b* of enclosing seal 330 is formed with an engaging hole 331, which is fixed to supporting structure 350 by its engagement with a supporting structure-side engaging projection 351 (FIG. 15) formed in supporting structure 350.

Since third container part 317 of container body 310 is constructed as above, when enclosing seal 330 is peeled off by rotation of container body 310 of toner container 300, enclosing seal 330 engaged with supporting structure-side engaging projection 351 is pulled in such a direction to be peeled off toner discharge aperture 314 as container body 310 rotates in the direction of arrow R. As a result, first end 330*a* of enclosing seal 330 is peeled off toner discharge aperture 314 to thereby open toner discharge aperture 314.

On the other hand, when container body 310 rotates in the direction opposite the direction of arrow R, enclosing seal 330 hooked by supporting structure-side engaging projection 351 is pulled in the direction to close toner discharge aperture 314. Hence, toner discharge aperture 314 will not open and the rotation of container body 310 in the opposite direction can be prevented. Thus, container body 310 can be stabilized without its being rattled during transportation of toner container 300.

As to the material of enclosing seal 330, polyethylene terephthalate (PET) and the like can be used. However, the material is not limited to this. That is, other materials such as polyethylene, polypropylene, felt and the like may be used as long as they present air permeability, good slidability and can bond and seal toner discharge aperture 314.

In the present embodiment, the enclosing seal 330 is formed of a sheet of paper made of polyester (PET) or the like, being coated with a felt made of extra fine polyester fiber, specifically, a product of Du Pont Kabushiki Kaisha "Tyvek (registered trademark)".

On the other hand, supporting structure 350 is constructed of, as already described, approximately semi-cylindrical first and second supporting members 350*a* and 350*b*, and this supporting structure 350 rotatably supports third container part 317 located in the approximate center of container body 310.

First supporting member 350*a* has an approximately semi-cylindrical configuration as shown in FIG. 15A and is formed with the aforementioned toner feed aperture 300*a* at the approximate center of its inner side curved surface portion 353*a*.

Also formed at the approximately center of the edge of inner side curved surface 353*a* of first supporting member 350*a* is a regulating recess 358 into which a regulating member 405*b* for limiting the moving range of the closing operation of a shutter element of the aftermentioned shutter opening and closing mechanism 400 (FIG. 5) fits.

Further, in order to secure the clearance for rotation of container body 310 as well as to secure the stability in supporting container body 310 by supporting structure 350 when container body 310 is supported by supporting structure 350, a pair of rib-like container body engaging portions 359*a* (FIG. 15) are formed on inner curved surface portion 353*a*. These container body engaging portions 359*a* are arranged in parallel to each other and spaced approximately the same distance as the width (the dimension in the direction of cylinder axis AX) of third container part 317 (FIG. 8). These engaging portions 359*a* are connected to corresponding container body engaging portions 359*b* formed on the aftermentioned second supporting member 350*b* when first supporting member 350*a* and second supporting member 350*b* are assembled to complete supporting structure 350. The thus constructed paired ribs of container body engaging portions 359*a* and 359*b* and inner peripheral curved surfaces 353*a* and 353*b* hold third container part 317 to thereby support container body 310 in a rotatable manner on supporting structure 350.

In addition, both the side edges (the parts that are connected to second supporting member 350*b*) of inner curved surface portion 353*a* are formed with first and second flanges 354*a* and 355*a*. In each of flanges 354*a* and 355*a*, fitting recesses 356*a* or 357*a* are formed at both longitudinal ends of the flange and are fitted to corresponding fitting projections 356*b* or 357*b* formed at both longitudinal ends of the flange 354*b* or 355*b* of aftermentioned second supporting member 350*b*. Formed at the approximate center of first flange 354*a* is supporting structure-side engaging projection 351 for engagement with engaging hole 331 formed at the other end 330*b* of enclosing seal 330 (FIG. 8). Further, formed on the outer side of first supporting member 350*a*, at the position where toner feed aperture 300*a* is formed, is shutter opening and closing mechanism 400 (FIG. 14) for opening and closing toner feed aperture 300*a*.

Toner feed aperture 300*a* formed in first supporting structure 350*a* is disposed at a position more upstream, with respect to the rotational direction R, from the position which toner discharge aperture 314 of container body 310 opposes when it is positioned at the bottom dead center of its rotation, as shown in FIGS. 16A and 16B.

In toner feed aperture 300*a* a scraper 301 with a Mylar™ film 302 (or another similar thin film having flexibility and durability) is arranged at a position close to container body 310 and corresponding to first toner feed hollow 313 (FIGS. 12 and 13) and second toner feed hollow 323.

As shown in FIG. 16B, scraper 301 has a flat square configuration smaller than toner feed aperture 300*a* of a square shape, and is pivotally urged so that its Mylar™ film 302 abuts container body 310 which is mounted in supporting structure 350. In this arrangement, Mylar™ film 302 abuts and slides over the outer peripheral surface of container body 310, first toner feed aperture 313 and second toner feed aperture 323 and regulates the opening range of the opening that communicates with toner feed aperture 300*a* in accordance with the condition in which scraper 301 abuts and slides over the outer peripheral surface of container body 310, first toner feed aperture 313 and second toner feed aperture 323.

Mylar™ film 302 has a width W5, which is approximately equal to the surface opening width W1 of first toner feed hollow 313 and the surface opening width W4 of second toner feed hollow 323, and is adapted to abut the hollows of first toner feed hollow 313 and second toner feed hollow 323 while container body 310 is rotating, to thereby scrape off the toner that was discharged in the hollows.

Second supporting member 350*b* also has an approximately semi-cylindrical configuration as shown in FIG. 15B. Similarly to first supporting member 350*a*, in order to secure the clearance for rotation of container body 310 as well as to secure the stability in supporting container body 310 by supporting structure 350 when container body 310 is supported by supporting structure 350, a pair of rib-like container body engaging portions 359*b* are formed on inner curved surface portion 353*b*. These container body engaging portions 359*b* are arranged in parallel to each other and spaced approximately the same distance as the width of third container part 317. In addition, both the side edges of inner curved surface portion 353*b* are formed with first and second flanges 354*b* and 355*b*. In each of flanges 354*b* and 355*b*, fitting projections 356*b* or 357*b* are formed at both longitudinal ends of the flange and are fitted correspondingly to the aforementioned fitting recesses 356*a* or 357*a* formed at both longitudinal ends of the flange 354*a* or 355*a* of the aforementioned first supporting member 350*a*. Formed at the approximate center of first flange 354*b* is an engaging recess 352 that fits supporting structure-side engaging projection 351 formed in first flange 354*a* of first supporting member 350*a*.

As first supporting member 350*a* and second supporting member 350*b* are thus configured as above, first flange 354*a* of first supporting member 350*a* is joined to first flange 354*b* of second supporting member 350*b*, and second flange 355*a* of first supporting member 350*a* is joined to second flange 355*b* of second supporting member 350*b*, to thereby complete the approximately cylindrical supporting structure 350 which supports container body 310 in a rotatable manner over the whole circumference.

According to the present embodiment described as above, toner feed recess 303 is formed of first toner feed hollow 313 and second toner feed hollow 323, and these hollows are arranged so that the end part on the upstream side, with respect to the rotational direction R, of first toner feed hollow 313 is positioned between parts of second toner feed hollow 323, so that the toner leaking out from first toner feed hollow 313 to the outer peripheral surface can be put together and collected by second toner feed hollow 323. As a result, the toner discharged from container body 310 can be efficiently supplied to toner feed aperture 300*a* without dirtying container body 310 with leaking toner, hence it is possible to improve workability and maintenance performance when container body 310 is handled.

Further, according to the present embodiment, in first toner feed hollow 313, slope 313*b*1 is formed contiguously from bottom wall portion 313*b* so that the hollow depth continuously becomes smaller toward outer peripheral surface 313*e*. Accordingly, the toner discharged to first toner feed hollow 313 can be efficiently collected and conveyed toward toner feed aperture 300*a* as the container body rotates.

Furthermore, according to the present embodiment, bottom wall portion 323*c*2 of second toner feed hollow 323 is formed so as to have surface opening width W3 that is the sum of W1, the width of outer peripheral surface 313*e* and two times of W2, the surface opening width of bottom wall portion 323*a*2 and 323*b*2, and its upstream end 323*c*3 is formed so that its surface opening width becomes smaller toward the upstream side with respect to the rotational direction R. Therefore, it is possible to efficiently put together and convey the collected toner by second toner feed hollow 313 toward toner feed aperture 300*a* as the container body rotates. In addition, since the narrowed end part is connected to slope 323*c*1 so that the hollow becomes shallower or the vertical sectional area of the opening of the hollow in which toner is pooled becomes smaller as it goes toward the upstream side with respect to the rotational direction R of container body 310, the toner can be discharged more efficiently.

Further, according to the present embodiment, surface opening width W1 of first toner feed hollow 313 is formed so as to be approximately equal to the opening width of toner feed aperture 300*a*. Upstream end portion 323*c*3 of second toner feed hollow 323 is formed so that its surface opening becomes narrower as it goes toward the upstream stream side with respect to the rotational direction R while slope 323*c*1 is formed so as to have surface opening width W4 that is equal to the width of toner feed aperture 300*a*. Further, the width W5 of Mylar™ film 302 attached to scraper 301 is formed to be approximately equal to surface opening width W1 of first toner feed hollow 313 and surface opening width W4 of second toner feed hollow 323. Combination of all these specifications contributes to efficient supply of the discharged toner to toner feed aperture 300*a*.

Though the above description was made taking an example of a preferred embodiment of the present technology with reference to the accompanying drawings, it goes without saying that the present technology should not be limited to this example. It is apparent that various modifications, variations and modified examples will occur to those skilled in the art without departing from the spirit or scope of the following claims, and those should be considered to be within the technical scope of the technology.

For example, in the above first embodiment, the present technology is applied to the toner container to be mounted to a monochrome image forming apparatus. However, the present invention can be also applied to the toner containers for a color image forming apparatus.

What is claimed is:

1. A toner container, comprising:

a cylindrical container to be filled with toner and having a toner discharge port for discharging toner from an interior of the container; and a toner container supporting structure, which supports the container in a rotatable manner by enclosing the toner discharge port and that has a toner feed port for feeding the toner discharged from the toner discharge port to the outside, the container being rotatable about a longitudinal axis of the cylindrical container so as to discharge toner stored in the container to the outside of the container, wherein a first recess in an outer wall the cylindrical container that is indented into the interior of the container forms a first toner pool for temporarily holding toner discharged from the toner discharge port, the first recess extending alone the outer wall from the toner discharge port in an upstream direction with respect to the rotational direction of the container wherein a second recess in the outer wall of the cylindrical container forms a second toner pool for temporarily holding toner discharged from the toner discharge port, and wherein the first toner pool opens into the second toner pool such that toner can move directly from the first toner pool into the second toner pool.

2. The toner container according to claim 1, wherein a width of the first toner pool in a direction extending parallel to a central longitudinal axis of the cylindrical container is approximately equal to an opening width of the toner feed port.

3. The toner container according to claim 1, wherein the toner feed port is disposed on the toner container supporting structure at a position more upstream, with respect to the rotational direction, from a position which the toner discharge port opposes when the toner discharge port is positioned at a bottom dead center of rotation.

4. A toner supply device, comprising:

a toner container filled with toner; and a toner feed device having the toner container mounted thereto for feeding toner discharged from the toner container to a developing unit, characterized in that the toner container is a toner container according to claim 1.

5. An image forming apparatus, comprising:

a toner container filled with toner; and a toner feed device having the toner container mounted thereto for feeding toner discharged from the toner container to a developing unit, and having a function of supplying toner to the developing unit in accordance with a usage condition of the toner to be consumed for image output, characterized in that the toner container is a toner container according to claim 1.

6. The toner container according to claim 1, wherein a depth of a portion of the first toner pool located at the upstream end of the first toner pool becomes more shallow from the downstream end thereof to the upstream end thereof.

7. The toner container according to claim 1, wherein the second recess that forms the second toner pool is generally Y-shaped, and wherein arms of the Y-shaped second recess are located on opposite sides of an end of the first recess that forms the first toner pool.

8. The toner container according to claim 7, wherein the arms of the Y-shaped second recess are located at a downstream end of the second recess.

9. The toner container according to claim 8, wherein the end of the first recess located between the arms of the Y-shaped second recess is an upstream end of the first recess.

10. The toner container according to claim 8, wherein an upstream end of the Y-shaped second recess tapers inward towards a central longitudinal axis of the second recess.

11. The toner container according to claim 8, wherein a depth of an upstream end of the Y-shaped second recess becomes smaller from a downstream end thereof to an upstream end thereof.

12. A toner container, comprising:

a cylindrical toner container comprising:

a first recess formed in an outer wall of the container, wherein a toner discharge port that allows toner from within the container to escape the container is formed in a sidewall of the first recess, and a second recess formed in the outer wall of the container; and a toner container supporting structure mounted around an exterior of the toner container so as to cover the first and second recesses, wherein the toner container supporting structure allows the cylindrical toner container to rotate about a central longitudinal axis of the toner container, and wherein the toner container supporting structure includes a toner feed port that allows toner that has escaped from within the toner container through the toner discharge port to escape the toner container supporting structure, wherein the toner feed port is located on the toner container supporting structure at a location that is immediately adjacent to and slightly more upstream, with respect to the rotational direction, from a position which the toner discharge port opposes when the toner discharge port is positioned at a bottom dead center of rotation.

13. The toner container according to claim 12, wherein the first recess and the second recess partially overlap such that toner located in the first recess can move directly into the second recess.

14. The toner container according to claim 12, wherein the first recess extends along the outer wall from the toner discharge port in an upstream direction with respect to the rotational direction of the toner container.

15. The toner container according to claim 14, wherein an upstream end of the first recess overlaps with a downstream end of the second recess such that toner located in the first recess can move directly into the second recess as the toner container rotates.

16. The toner container according to claim 15, wherein the second recess is Y-shaped, with arms of the Y-shaped second recess forming the downstream end of the second recess.

17. The toner container according to claim 16, wherein the arms of the Y-shaped second recess are located on opposite sides of the upstream end of the first recess.

18. The toner container according to claim 14, wherein the upstream ends of the first and second recesses become progressively more shallow as they approach their respective upstream edges.

19. The toner container according to claim 18, wherein an upstream end of the first recess overlaps with a downstream end of the second recess such that toner located in the first recess can move directly into the second recess as the toner container rotates.

* * * * *